US007570907B2

(12) United States Patent
Muroi

(10) Patent No.: US 7,570,907 B2
(45) Date of Patent: Aug. 4, 2009

(54) IMAGE FORMING APPARATUS AND IMAGE FORMING METHOD

(75) Inventor: Kazushige Muroi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 421 days.

(21) Appl. No.: 11/294,452

(22) Filed: Dec. 6, 2005

(65) Prior Publication Data

US 2006/0140685 A1 Jun. 29, 2006

(30) Foreign Application Priority Data

Dec. 24, 2004 (JP) ..... 2004-374375

(51) Int. Cl.
*G03G 15/01* (2006.01)

(52) U.S. Cl. ..... 399/301; 399/302; 347/116

(58) Field of Classification Search ..... 399/301–302, 399/31, 179, 299; 347/116
See application file for complete search history.

(56) References Cited

U.S. PATENT DOCUMENTS 3,983,468 A * 9/1976 Maitrias ..... 318/685

FOREIGN PATENT DOCUMENTS

| | | |
|---|---|---|
| JP | A 2000-198624 | 7/2000 |
| JP | A 2002-091264 | 3/2002 |
| JP | A 2002-225374 | 8/2002 |
| JP | A 2004-021236 | 1/2004 |
| JP | A 2004-198624 | 7/2004 |

* cited by examiner

*Primary Examiner*—David M Gray
*Assistant Examiner*—Geoffrey T Evans
(74) *Attorney, Agent, or Firm*—Oliff & Berridge, PLC

(57) ABSTRACT

If a velocity calculated by a velocity calculating unit deviates from a normal range, a target velocity is used as a feedback amount, an actuation amount corresponding to a deviation Ve=0 between the feedback amount Vf=Vt and the target velocity Vt is calculated, and a driving power corresponding to this actuation amount is supplied to a motor. A conveyor belt can be driven stably without causing irregularity in a speed of the conveyor belt.

1 Claim, 13 Drawing Sheets

IMAGE FORMING APPARATUS AND IMAGE FORMING METHOD

CROSS-REFERENCE TO RELATED APPLICATION

This application is based on and claims the benefit of priority from the prior Japanese Patent Application No. 2004-374375, filed on Dec. 24, 2004; the entire contents of which are incorporated herein by reference.

TECHNICAL FIELD

The present invention relates to an image forming apparatus, such as a laser printer, and an image forming method thereof.

BACKGROUND

For example, a tandem color laser printer is provided with a sheet conveyor belt or an intermediate transfer belt. A color laser printer provided with the sheet conveyor belt adopts a so-called direct transfer method. In this direct transfer method, during conveyance of a sheet by the sheet conveyor belt, toner images of respective colors of yellow, magenta, cyan and black are sequentially superimposed on and transferred to the sheet. Meanwhile, a color laser printer provided with the intermediate transfer belt adopts a so-called indirect transfer method. In this indirect transfer method, after toner images of respective colors of yellow, magenta, cyan and black are sequentially superimposed on and transferred to the intermediate transfer belt, a toner image on the intermediate transfer belt is transferred to a sheet at a time.

During the transfer of a toner image of each color, driving of the belts is controlled in a feedback manner such that the speed (traveling speed) of the sheet conveyor belt or the intermediate transfer belt is detected, and the speed of both belts is maintained at constant speed on the basis of the detected speed. If there is irregularity in the speed of the belts, deviation is caused in the transfer position of a toner image of each color on the sheet or the intermediate transfer belt. Therefore, the feedback control requires high precision.

As a technique of detecting the speed of each belt, for example, it is considered that an encoder is attached to a belt-supporting roller, the rotational speed of the roller is obtained from output pulses from the encoder, and the speed of the belt is calculated (estimated) on the basis of the obtained rotational speed. However, because the belt is an elastic body, the speed of the belt changes due to micro-vibration caused during traveling of the belt, even when the roller rotates at constant rotational speed. Accordingly, since the speed of the belt calculated from the rotational speed of the roller is not necessarily equal to an actual speed of the belt, the rotational speed cannot be used to control driving of the belt.

Thus, for example, JP-A-2004-198624 suggests providing an intermediate transfer belt with a scale in which a number of scale slits are formed at regular intervals, providing a sensor that outputs signals in response to the detection of the scale slits, at a position where the scale can be read, and calculating the speed of the intermediate transfer belt on the basis of the interval (interval from a previous output signal to the next output signal) of output signals from the sensor during driving of the intermediate transfer belt.

SUMMARY

In considering the expansion and contraction caused by the elasticity of the intermediate transfer belt, the scale should be provided so that its joints (when one scale is wound along the surface of the intermediate transfer belt, the joints are mutually butting opposite ends of the scale, and when a plurality of scales are provided in series, the joints are scales adjacent to each other in a direction that the scales are arrayed) do not overlap each other. However, if such joints exist, when portions of the joints become target positions to be detected by the sensor, the interval of output signals of the sensor becomes long and consequently the speed of the intermediate transfer belt that is lower than the actual speed is detected.

FIG. 15 is a graph (the abscissa represents time and the ordinate represents the output time interval of signals from a sensor) showing changes in the interval of output signals of the sensor. If a joint exists in the scale, as shown in the graph, when portions other than the joint become target positions to be detected by the sensor, signals are output from the sensor about every 4.25 msec. However, when the portions of the joint become the target positions to be detected by the sensor (time T), the next signal is output after about 5.3 msec from when a signal is output from the sensor immediately before the time T. As described above, if the interval of output signals of the sensor becomes long and consequently the sensor detects the speed of the intermediate transfer belt which is lower than an actual speed, the rotational speed of a motor that drives the intermediate transfer belt is increased by feedback control. As a result, great irregularity may be caused in the speed of the intermediate transfer belt in front of or behind the positions.

Thus, JP-A-2004-198624 suggests determining that, if output signals of the sensor do not change over a predetermined time, a target position to be detected by the sensor is a joint of the scale, and controlling the driving of the intermediate transfer belt in a feedback manner, by using the speed of the intermediate transfer belt that has been just previously detected. However, an immediate value of the speed of the intermediate transfer belt which has been just previously detected is not necessarily detected precisely, but it is often incorrectly detected by influence of noises, which may also result in feedback control that may cause irregularity in the speed of the intermediate transfer belt.

The present invention has been made in view of the above circumstances and provides an image forming apparatus and an image forming thereof, which can stably rotate a rotating body, such as belts.

According to at least some example aspects of the invention, an image forming apparatus includes a rotating body rotating integrally with a plurality of marks provided at intervals with one another; a sensor that outputs pulses whenever each mark is detected; an actual interval measuring unit that measures an actual interval that is an output interval of the pulses from the sensor; a selecting unit that, if a current actual interval measured by the actual interval measuring unit is within a predetermined normal range, selects the current actual interval as a feedback amount, and that, if a current actual interval measured by the actual interval measuring unit is out of the predetermined normal range, selects a mean value of a plurality of actual intervals measured in the past by the actual interval measuring unit instead of the current actual interval, as a feedback amount; and a control unit that compares a target interval that is a target value of the output interval of the pulses from the sensor with the feedback amount selected by the selecting unit to control rotation of the rotating body in a feedback manner so that a deviation between the target interval and the feedback amount becomes zero.

In the above aspect of the invention, the image forming apparatus further includes a storage unit that stores a plurality of actual intervals measured by the actual interval measuring unit during the past predetermined period; and a mean value calculating unit that calculates a mean value of the plurality of actual intervals stored in the storage unit.

In the above aspect of the invention, the mean value of the plurality of actual intervals is a mean value of a plurality of actual intervals within the normal range measured in the past by the actual interval measuring unit.

In the above aspect of the invention, the mean value of the plurality of actual intervals is a mean value of a plurality of actual intervals measured by the actual interval measuring unit, during a period from when an actual interval out of the normal range is measured by the actual interval measuring unit to when another actual interval out of the normal range is measured next by the actual interval measuring unit.

According to an another aspect of the invention, an image forming apparatus includes a rotating body rotating integrally with a plurality of marks provided at intervals with one another; a sensor that outputs pulses whenever each mark is detected; an actual interval measuring unit that measures an actual interval that is an output interval of the pulses from the sensor; a selecting unit that, if a current actual interval measured by the actual interval measuring unit is within a predetermined normal range, selects the current actual interval as a feedback amount, and that, if a current actual interval measured by the actual interval measuring unit is out of the normal range, selects a target interval that is a target value of the output interval of the pulses from the sensor, instead of the current actual interval, as a feedback amount; and a control unit that compares the target interval with the feedback amount selected by the selecting unit to control rotation of the rotating body in a feedback manner so that a deviation between the target interval and the feedback amount becomes zero.

In the above aspects of the invention, the normal range is set based on an actual interval measured by the actual interval measuring unit. According to this configuration, the normal range can be a range corresponding to characteristics of each image forming apparatus.

In the above aspects of the invention, the predetermined normal range is set to a range that is broader than an error range of the actual interval measured by the actual interval measuring unit.

In the above aspects of the invention, the predetermined normal range is set to a range obtained by multiplying the error range of the actual interval measured by the actual interval measuring unit by a predetermined factor.

In the above aspects of the invention, the rotating body is one that conveys a recording medium, and the image forming apparatus further includes a supplying unit that supplies a recording medium to the rotating body, and a supply control unit that controls supply start timing of a recording medium by the supplying unit so as to complete conveyance of the recording medium by the rotating body, during a period from when an actual interval out of the normal range is measured by the actual interval measuring unit to when another actual interval out the normal range is measured next by the actual interval measuring unit, if actual intervals measured by the actual interval measuring unit are periodically out of the predetermined normal range.

In the above aspects of the invention, the image forming apparatus further includes: a period detecting unit that, when actual intervals measured by the actual interval measuring unit are periodically out of the predetermined normal range, detects the period, and an elapsed time measuring unit that measures an elapsed time after an actual interval out of the normal range is measured by the actual interval measuring unit. If the remaining time obtained by subtracting the time taken from the start of the supply of a recording medium by the supplying unit to the completion of conveyance of the recording medium by the rotating body, from the period detected by the period detecting unit, is longer than the elapsed time measured by the elapsed time measuring unit, the supply control unit states supplying of a recording medium by the supplying unit.

In the above aspects of the invention, the image forming apparatus further includes a positional deviation amount calculating unit that calculates, as a positional deviation amount, a cumulative value of deviations between a predetermined basic target interval and actual intervals measured by the actual interval measuring unit, and a positional deviation compensating unit that set, as the target interval, a deviation between the basic target interval and a value obtained by multiplying the positional deviation amount calculated by the positional deviation amount calculating unit by a predetermined proportional gain.

In the above aspects of the invention, the rotating body is a conveyor belt that conveys a recording medium, and the apparatus further includes a plurality of image forming unit that are arranged in parallel along a direction in which the recording medium is conveyed by the conveyor belt so as to form images of the recording medium.

BRIEF DESCRIPTION OF THE DRAWINGS

Illustrative example structures in accordance with the present invention will be described in detail with reference to the following figures wherein.

DETAILED DESCRIPTION

Figure 1:
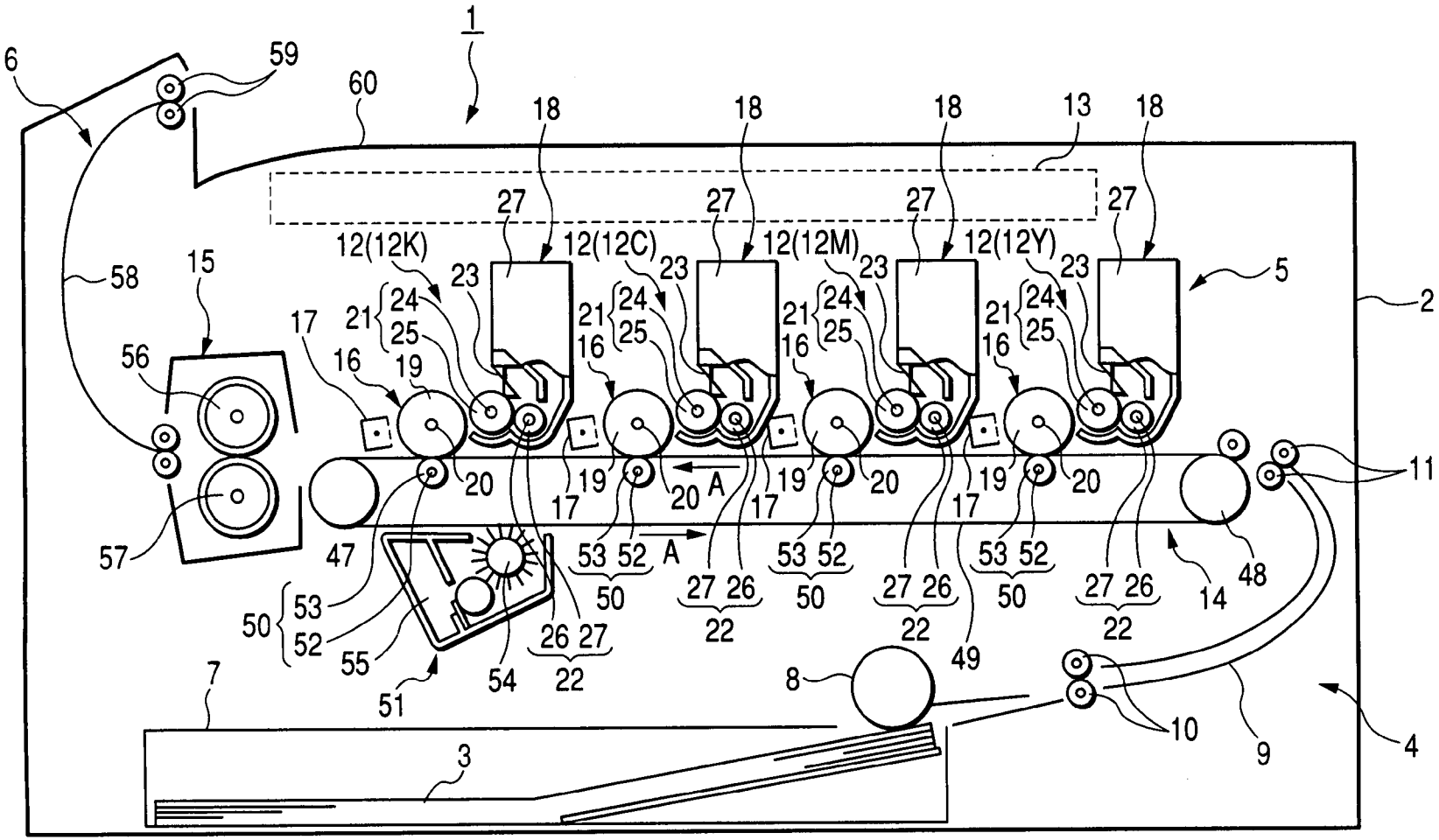
FIG. 1 is a side sectional view showing an a color laser printer as an image forming apparatus according to an illustrative example of the invention.

FIG. 1 is a side sectional view showing a color laser printer serving as an image forming apparatus according to an example structure. The color laser printer 1 is a tandem color laser printer in which a plurality of process units 16 are arranged in tandem with each other in a horizontal direction. The color laser printer 1 includes, in a box-shaped main casing 2, a sheet feeding part 4 that feeds a sheet 3 as a recording medium, an image forming part 5 that forms an image on the sheet 3 fed therein, and a sheet discharge part 6 that discharges the sheet 3 on which the image is formed.

The sheet feeding part 4 includes a sheet cassette 7 provided at the inner bottom of the main casing 2, a sheet feeding roller 8 provided on the front upper side (in the following description, the left side in FIG. 1 is referred to as the rear side and the right side as the front side) of the sheet cassette 7, a U-shaped path 9 provided on the front upper side of the sheet feeding roller 8, a pair of conveying rollers 10 provided in the midway of the U-shaped path 9, and a pair of registration rollers 11 as a supplying unit.

A plurality of sheets 3 is stacked within the sheet cassette 7, and the uppermost sheet 3 in the cassette is delivered to the U-shaped path 9 by the rotation of the sheet feeding roller 8. The U-shaped path 9 is formed as a substantially U-shaped conveying path for the sheet 3 such that its upstream end is adjacent to the sheet feeding roller 8 on the lower side, and the sheet 3 is fed forward, and its downstream end is adjacent to a conveyor belt 49, as will be described below, on the upper side, and the sheet 3 is discharged rearward.

Then, the sheet 3 delivered to the U-shaped path 9 is conveyed within the U-shaped path 9 by the conveying rollers 10, and the sheet is discharged rearward by the registration rollers 11 after registration by the registration rollers 11. The image forming part 5 includes the process units 12 serving as image forming unit, a scanner unit 13, a transfer part 14, and a fixing part 15.

A process unit 12 is provided for each toner color of a plurality of toner colors. That is, the process units 12 include four process units, i.e., a yellow process unit 12Y, a magenta process unit 12M, a cyan process unit 26C, and a black process unit 12K. The process units 12 are sequentially arranged in parallel at intervals with one another from the front to the rear so as to overlap each other in the horizontal direction.

Each process unit 12 includes a photosensitive drum 16, a scorotron charger 17, and a developing cartridge 18.

Each photosensitive drum 16 is formed in a cylindrical shape, and includes a drum body 19 whose uppermost surface layer is formed by a positively charged photosensitive layer made of polycarbonate, etc., and a drum shaft 20 extending along an axial direction of the drum body 19 on an axis of the drum body 19. The drum body 19 is rotatably provided with respect to the drum shaft 20, and the drum shaft 20 is non-rotatably supported by both side walls of the process unit 12 in the width direction (the direction orthogonal to the forward and rearward direction and the vertical direction; this is true of the rest). During image forming, the photosensitive drum 16 is driven to rotate in the same direction (clockwise in the figure) as a circulating direction A of the conveyor belt 49 at a position (image formation position) where the photosensitive drum 16 makes contact with the conveyor belt 49 (as will be described below).

The scorotron charger 17 is a positively charged scorotron charger which has wires or grids and causes corona discharge. Behind the photosensitive drum 16, this scorotron charger is disposed to face the photosensitive drum 16 at a predetermined distance therefrom so as not to make contact with the photosensitive drum 16. The developing cartridge 18 includes a developing roller 21, a supply roller 22, and a layer thickness regulating blade 23 within a casing thereof.

The developing roller 21 is disposed to face the photosensitive drum 16 in front of the photosensitive drum 16, and is pressed against the photosensitive drum 16. The developing roller 21 is made by covering a metallic roller shaft 24 with a roller part 25 formed of an elastic member, such as conductive rubber material. More specifically, the roller part 25 is formed with a two-layer structure of an elastic roller portion and a coat layer that covers the surface of the roller portion. The elastic roller portion is made of conductive rubber, which contains carbon particles, such as urethane rubber, silicone rubber, and ethylene-propylene-diene-terpolymer (EPDM) rubber. The coat layer is made of urethane rubber, urethane resin, polyimide resin or other materials as a main ingredient. Further, the roller shaft 24 is rotatably supported by both side walls of the process unit 12 in the width direction.

The supply roller 22 is disposed to face the developing roller 21 in front of the developing roller 21, and is pressed against the developing roller 21. The supply roller 22 is made by covering a metallic roller shaft 26 with a roller part 27 made of conductive sponge member. Further, the roller shaft 26 is rotatably supported by both side walls of the process unit 12 in the width direction.

The layer thickness regulating blade 23 is made of metallic leaf spring member, and its tip portion is provided with a pressing member having a semicircular section and made of insulative silicon rubber. Also, the layer thickness regulating blade 23 is supported by the casing of the developing cartridge 18 above the developing roller 21, and the pressing member at the tip (lower end) is pressed against the roller part 25 of the developing roller 21 from the front upper side.

Further, an upper portion of the casing of the developing cartridge 18 is formed as a toner chamber which stores toner. The toner chamber stores toner for each color. Specifically, a positively charged nonmagnetic one-component polymerized toner having a yellow color is stored within a toner chamber of the yellow process unit 12Y, a positively charged nonmagnetic one-component polymerized toner having a magenta color is stored within a toner chamber of the magenta process unit 12M, a positively charged nonmagnetic one-component polymerized toner having a cyan color is stored within a toner chamber of the cyan process unit 12C, and a positively charged nonmagnetic one-component polymerized toner having a black color is stored within a toner chamber of a black process unit 12*k*.

More specifically, the toner of each color is a polymerized toner having substantially spherical particles obtained through polymerization. The polymerized toner has binder resin as the main ingredient, which is obtained through copolymerization of styrene-based monomers, such as styrene, and acryl-based monomers, such as acrylic acid, alkyl (C1-C4) acrylate, and alkyl (C1-C4) methacrylate, using a known polymerization method, such as suspension polymerization.

A coloring agent, a charge control agent, and wax are combined with the polymerized toner to form toner base particles. An external additive is also added to the polymerized toner to improve flowability.

As the coloring agent, each coloring agent of yellow, magenta, cyan, and black is combined. As for the charge control agent, combined is a charge control resin obtained through copolymerization of ion-based monomers having an ionized functional group, such as ammonium salt, and monomers that can be copolymerized with ion-based monomers, such as styrene-based monomers and acryl-based monomers. As for the external additive, combined is inorganic powder, such as metallic oxide powder, carbonized powder, and metal salt powder. The metallic oxide powder includes silica, aluminum oxide, titanium oxide, strontium titanate, ceric oxide, and magnesium oxide.

In each process unit 12, during the image forming operation, toner of each color stored in each toner chamber is supplied to the supply roller 22, and the toner is supplied to the developing roller 21 by the rotation of the supply roller 22. At this time, the toner is positively friction-charged between the supply roller 22 and the developing roller 21 to which a developing bias is applied. The toner supplied to the developing roller 21 goes in between the pressing member of the layer thickness regulating blade 23 and the developing roller 21 (roller part 25) along with the rotation of the developing roller 21, and then the toner is regulated to a thin layer having uniform thickness and carried on the developing roller 21.

Meanwhile, the scorotron charger 17 causes corona discharge by application of a charging bias so as to uniformly charge the surface of the photosensitive drum 16 positively. After the surface of the photosensitive drum 16 is uniformly charged positively by the scorotron charger 17 along with the rotation of the photosensitive drum 16, the surface is exposed by high-speed scanning of laser light from the scanner unit 13 as will be described below. As a result, an electrostatic latent image corresponding to an image to be formed on the sheet 3 is formed on the surface.

If the photosensitive drum 16 rotates further, the toner carried on the surface of the developing roller 21 and charged positively, is then supplied to the electrostatic latent image formed on the surface of the photosensitive drum 16, that is, an exposed portion of the uniformly positively charged surface of the photosensitive drum 16, whose potential is lowered by the exposure with the laser light, when the toner faces and makes contact with the photosensitive drum 16 by the rotation of the developing roller 21. As a result, the electrostatic latent image on the photosensitive drum 16 is visualized, and then a toner image for each color by reverse development is carried on the surface of the photosensitive drum 16.

Figure 2:
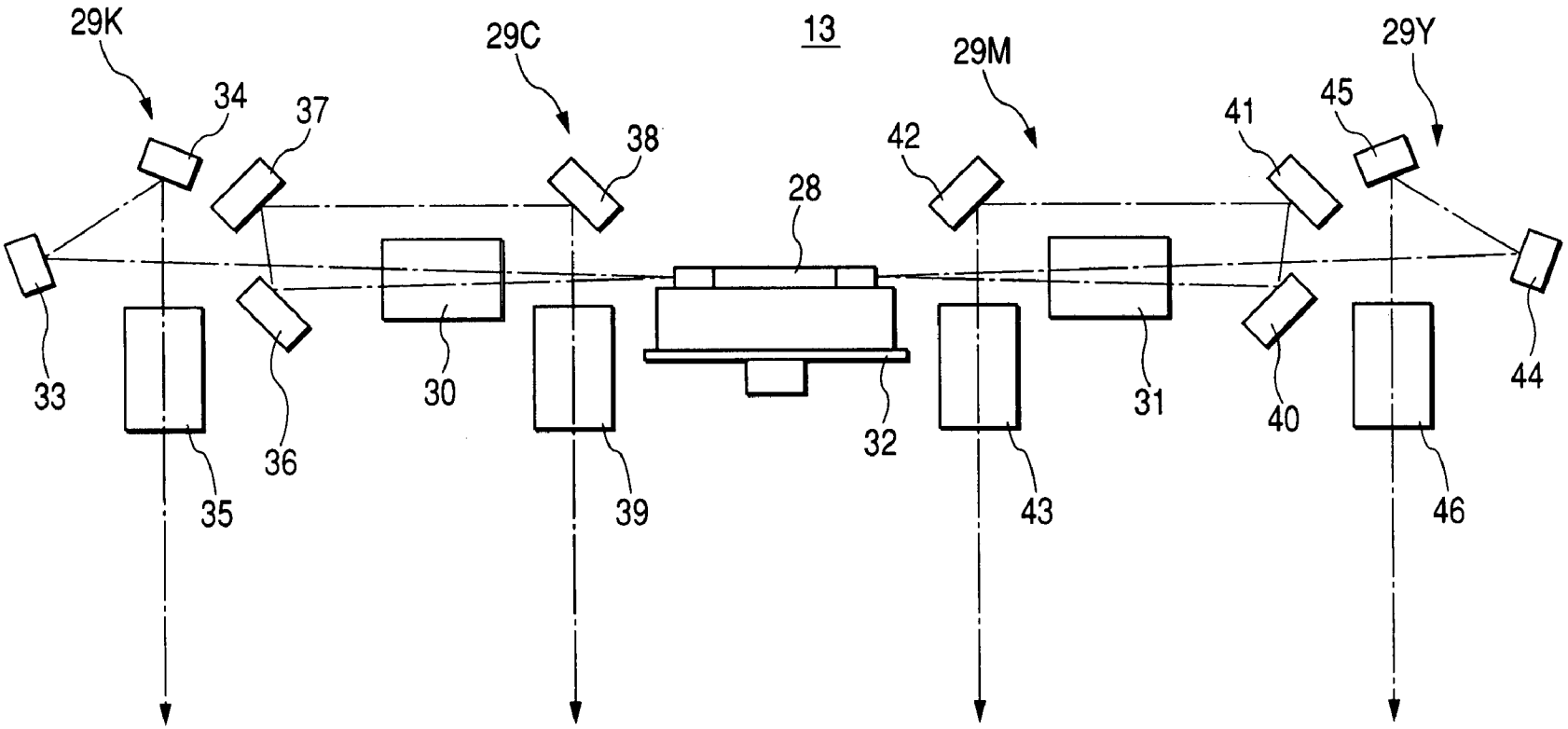
FIG. 2 is a side view for explaining the configuration of a scanner unit shown in FIG. 1.

As shown in FIG. 2, the scanner unit 13 includes a polygon mirror 28, a black scanning system 29K and a cyan scanning system 29C, which are provided behind the polygon mirror 28, a magenta scanning system 29M and a yellow scanning system 29Y, which are provided in front of the polygon mirror 28, an fθ lens 30 used in collaboration for the black scanning system 29K and the cyan scanning system 29C, and an fθ lens 31 used in collaboration for the magenta scanning system 29M and the yellow scanning system 29Y.

The polygon mirror 28 has a plurality of reflecting surfaces (for instance, six surfaces) at the sides, and is adapted to be rotated at high speed by a polygon motor 32 about the rotation axis extending in a vertical direction.

The black scanning system 29K includes a laser emitting part (not shown), reflecting mirrors 33 and 34, and a cylindrical lens 35. In the black scanning system 29K, a laser beam emitted from the laser emitting part, based on image data, is reflected by the polygon mirror 28, and passes through the fθ lens 30, and then is reflected by the reflecting mirrors 33 and 34 and passes through the cylindrical lens 35, and thus is emitted toward the photosensitive drum 16 of the black process unit 12K.

The cyan scanning system 29C includes a laser emitting part (not shown), reflecting mirrors 36, 37 and 38, and a cylindrical lens 39. In the cyan scanning system 29C, a laser beam emitted from the laser emitting part, based on image data, is reflected by the polygon mirror 28, and passes through the fθ lens 30, and then is reflected by the reflecting mirrors 36, 37 and 38 and passes through the cylindrical lens 39, and thus is emitted toward the photosensitive drum 16 of the cyan process unit 12C.

The magenta scanning system 29M includes a laser emitting part (not shown), reflecting mirrors 40, 41 and 42, and a cylindrical lens 43. In the magenta scanning system 29M, a laser beam emitted from the laser emitting part, based on image data, is reflected by the polygon mirror 28, and passes through the fθ lens 31, and then is reflected by the reflecting mirrors 40, 41 and 42 and passes through the cylindrical lens 43, and thus is emitted to the photosensitive drum 16 of the magenta process unit 12M.

The yellow scanning system 29Y includes a laser emitting part (not shown), reflecting mirrors 44 and 45, and a cylindrical lens 46. In the yellow scanning system 29Y, a laser beam emitted from the laser emitting part, based on image data, is reflected by the polygon mirror 28, and passes through the fθ lens 31, and then is reflected by the reflecting mirrors 44 and 45 and passes through the cylindrical lens 46, and thus is emitted toward the photosensitive drum 16 of the yellow process unit 12Y.

Referring to FIG. 1, the transfer part 14 is disposed above the sheet cassette 7 and in the forward and rearward direction below the process units 12 within the main casing 2, and includes a driving roller 47, a driven roller 48, the conveyor belt 49 serving as a rotating body, a transfer roller 50, and a belt cleaning device 51.

The driving roller 47 is disposed at a height position where it does not overlap the photosensitive drum 16 of the black process unit 12K in the horizontal direction behind the photosensitive drum 16 thereof. During image forming, the driving roller 47 is driven to rotate in a direction (counterclockwise in the figure) opposite to the direction of rotation of the photosensitive drum 16.

The driven roller 48 is disposed at a height position where it does not overlap the photosensitive drum 16 of the yellow process unit 12Y in the horizontal direction in front of the photosensitive drum 16 thereof. During rotational driving of the driving roller 47, the driven roller 48 is driven to rotate in the same direction (counterclockwise in the figure) as the circulating direction A of the conveyor belt 49 at a portion where the driven roller 48 makes contact with the conveyor belt 49 as will be described below.

The conveyor belt 49 is an endless belt and is formed of conductive resin, such as polycarbonate and polyimide, in which conductive particles, for example, carbon particles, are dispersed. The conveyor belt 49 is wound between the driving roller 47 and the driven roller 48. The conveyor belt 49 is disposed such that its wound outer contact surface faces and makes contact with all the photosensitive drums 16 of the process units 12.

When the driving roller 47 is driven, the driven roller 48 is rotated accordingly. Then, the conveyor belt 49 is circulated between the driving roller 47 and the driven roller 48 in the direction indicated by the arrow "A" (counterclockwise in the figure) so as to rotate in the same direction as the photosensitive drum 16 of each process unit 12 at the contact surface where the conveyor belt faces and makes contact with the photosensitive drum 16 thereof. The transfer roller 50 is disposed inside the conveyor belt 49 wound between the driving roller 47 and the driven roller 48 so as to face the photosensitive drum 16 of each process unit 12 with the conveyor belt 49 interposed therebetween. The transfer roller 50 is made by covering a metallic roller shaft 52 with a roller part 53 formed of an elastic member, such as conductive rubber material. The roller shaft 52 is disposed so as to extend in the width direction and rotatably supported. The transfer roller 50 rotates in the same direction (clockwise in the figure) as the circulating direction A of the conveyor belt 49 about the roller shaft 52 as a fulcrum, at an image formation position where the transfer roller faces and makes contact with the conveyor belt 49. During transfer, a transfer bias is applied to the transfer roller 50 by the roller shaft 52.

The sheet 3, supplied from the sheet feeding part 4, is conveyed by the conveyor belt 49, which is circulated by the driving roller 47 and the driven roller 48 so as to sequentially pass through image formation positions between the conveyor belt 49 and the photosensitive drums 16 of the process units 12 from the front toward the rear. While the sheet 3 is conveyed, toner images of respective colors formed on the photosensitive drums 16 of the process units 12 are sequentially transferred to the sheet 3, thereby forming a color image on the sheet 3.

Specifically, for example, when a yellow toner image carried on the surface of the photosensitive drum 16 of the yellow process unit 12Y is transferred to the sheet 3, a magenta toner image carried on the surface the photosensitive drum 16 of the magenta process unit 12M is then superimposed on and transferred to the sheet 3 where the yellow toner image has already been transferred. In a similar manner, a cyan toner image carried on the surface of the cyan process unit 12C and a black toner image carried on the surface of the black process unit 12K are sequentially superimposed on and transferred to the sheet, thereby forming a color image on the sheet 3.

In such color image formation, since the color laser printer 1 is a tandem printer in which a plurality of process units 12 are provided for the respective colors, the toner image of each color can be formed at almost the same speed as that for monochrome image formation, thereby achieving rapid color image formation. Thus, it is possible to form a color image while the printer is made small.

The belt cleaning device 51 is disposed in the vicinity of the driving roller 47 below the conveyor belt 49. The belt cleaning device 51 includes a cleaning member 54 which is disposed in contact with the surface of the conveyor belt 49 to scrape off paper dust or toner adhered to the surface of the conveyor belt 49, and a cleaning box 55 which collects and reserves the paper dust or toner scraped off by the cleaning member 54.

The fixing part 15 is disposed behind the transfer part 14. The fixing part 15 includes a heating roller 56 and a pressing roller 57.

The heating roller 56 is made of a metal tube on the surface of which a release layer is formed, and includes a halogen lamp along its axial direction. The surface of the heating roller 56 is heated to a fixing temperature by the halogen lamp. Further, the pressing roller 57 is provided so as to press against the heating roller 56.

The color image transferred onto the sheet 3 is then conveyed to the fixing part 15, and is fixed on the sheet 3 by being heated and pressed while passing between the heating roller 56 and the pressing roller 69.

The sheet discharge part 6 includes a sheet discharge path 58, sheet discharge rollers 59, and a sheet discharge tray 60. The sheet discharge path 58 is formed as a conveying path for the sheet 3 such that its upstream end is adjacent to the fixing part 15 on the lower side, its downstream end is adjacent to the sheet discharge tray 60 on the upper side, and the sheet is discharged toward the upper side.

The sheet discharge rollers 59 are provided as a pair of rollers at the downstream end of the sheet discharge path 58. The sheet discharge tray 60 is formed on the top surface of the main casing 2 as an inclined wall which is inclined downwardly from the front toward the rear.

The sheet conveyed from the fixing part 15 is discharged onto the sheet discharge tray 60 toward the front through the sheet discharge path 58 by the sheet discharge rollers 59.

Figure 3:
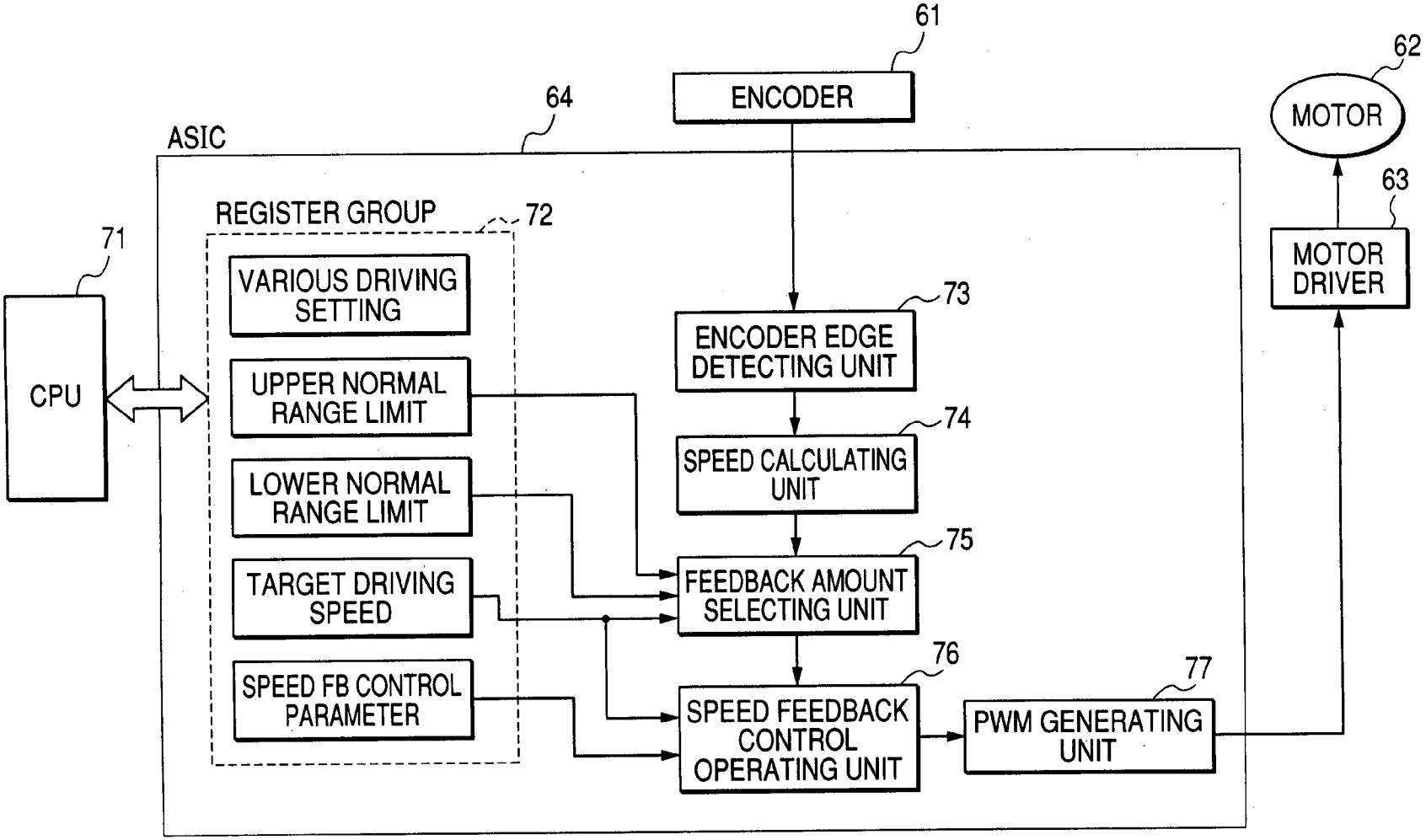
FIG. 3 is a block diagram showing a control system for speed control of a conveyor belt shown in FIG. 1.

FIG. 3 is a block diagram showing a control system for speed control of the conveyor belt 49.

The color laser printer 1 includes an encoder 61 which outputs pulse signals along with the circulation of the conveyor belt 49, a motor 62 which generates a driving force for rotatingly driving the driving roller 47 (conveyor belt 49), a motor driver 63 for supplying a driving current to the motor 62, and an ASIC 64 having a function to control the motor 62 so that the conveyor belt 49 is driven at constant speed by the motor driver 63 on the basis of the output signals from the encoder 61.

Figure 4:
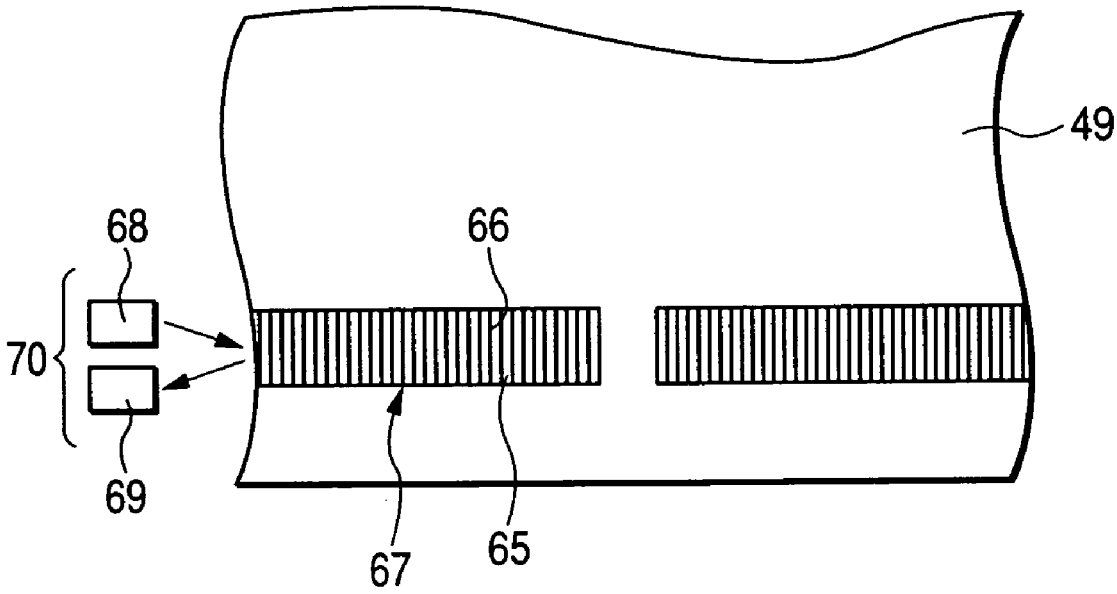
FIG. 4 is a view for explaining the configuration of an encoder shown in FIG. 3.

As shown in FIG. 4, the encoder 61 includes a pattern member 67 having a linear encoder pattern on which a number of marks 66 having optical reflectance, different from the base member 65, are formed on a strip-shaped base member 65 at equal intervals in the longitudinal direction, and a reflective sensor 70 serving as a sensor configured by a light-emitting element 68 and a light-receiving element 69.

The pattern member 67 is wound around the surface of the conveyor belt 49 at one end of the conveyor belt 49 in the width direction. Both ends of the pattern member 67 are not connected to each other, and the pattern member 67 has a joint of minute width between its both ends.

The reflective sensor 70 is disposed such that the light from the light-emitting element 65 is radiated onto the pattern member 67, and the light reflected by the pattern member 67 enters the light-receiving element 69. Since the base member 65 and the marks 66 of the pattern member 67 are different in optical reflectance from each other, the level of the output signal from the reflective sensor 70 (light-receiving element 69) is switched to either a high level and a low level depending on whether the light from the light-emitting element 68 is reflected on the base member 65 or reflected on the marks 66. Accordingly, during the circulation (driving) of the conveyor belt 49, when the pattern member 67 is irradiated with the light from the light-emitting element 68, the output signals from the reflective sensor 70 are switched alternately between a high level and a low level at timed intervals corresponding to the speed of the conveyor belt 49.

Referring to FIG. 3, the ASIC 64 includes a CPU 71, a register group 72 for storing various kinds of data, an encoder edge detecting unit 73 executed by a hardware configuration or executed in software through processing of programs by the CPU 71, a speed calculating unit 74 serving as an actual interval measuring unit, a feedback amount selecting unit 75 serving as a selecting unit, a feedback control operating unit 76 serving as a control unit, and a pulse-width-modulation (PWM) generating unit 77.

The output signals of the encoder 61 (reflective sensor 70) are input to the encoder edge detecting unit 73. The encoder edge detecting unit 73 detects an edge (switching from a high level to a low level, or switching from a low level to a high level) of an output signal of the encoder 61.

The speed calculating unit 74 calculates a speed V of the conveyor belt 49 on the basis of the results detected by the encoder edge detecting unit 73. Specifically, the distance of the marks 66 on the pattern member 67 is divided by an elapsed time from when an edge of an output signal of the encoder 61 is first detected to when the edge of another output signal of the encoder 61 is detected next, whereby the speed V of the conveyor belt 49 is then calculated.

The feedback amount selecting unit 75 reads out a upper normal range limit $V_U$, a lower normal range limit $V_L$, and a target speed Vt, which are stored in the register group 72, compares a current speed V of the conveyor belt 49 calculated by the speed calculating unit 74 with the upper normal range limit $V_U$ and the lower normal range limit $V_L$, respectively, so as to determine whether or not the current speed is greater than the normal range upper or lower limit, and selects any one of the current speed V and the target speed Vt of the conveyor belt 49 as a feedback amount Vf.

The speed feedback control operating unit 76 reads out the target speed Vt stored in the register group 72 and calculates a deviation Ve between the target speed Vt and the feedback amount Vf selected by the feedback amount selecting unit 75. Then, the speed feedback control operating unit 76 reads out a speed FB control parameter stored in the register group 72 so as to perform control operation using the speed FB control parameter to operate an actuation amount U corresponding to the deviation Ve between the target speed Vt and the feedback amount Vf.

The PWM generating unit 77 generates a PWM control signal corresponding to the actuation amount U operated by the speed feedback control operating unit 76 so as to give the generated PWM control signal to the motor driver 63.

When the PWM control signal are given to the motor driver 63 from the PWM generating unit 77, each driving element (for instance, FET) included in the motor driver 63 is turned on/off, and driving power corresponding to the ON/OFF is supplied to the motor 62 from the motor driver 63. As a result, the motor 62 is rotatingly driven, and the driving roller 47 is then rotated by the driving force of the motor 62 to circulate the conveyor belt 49 at the target speed Vt.

Figure 5:
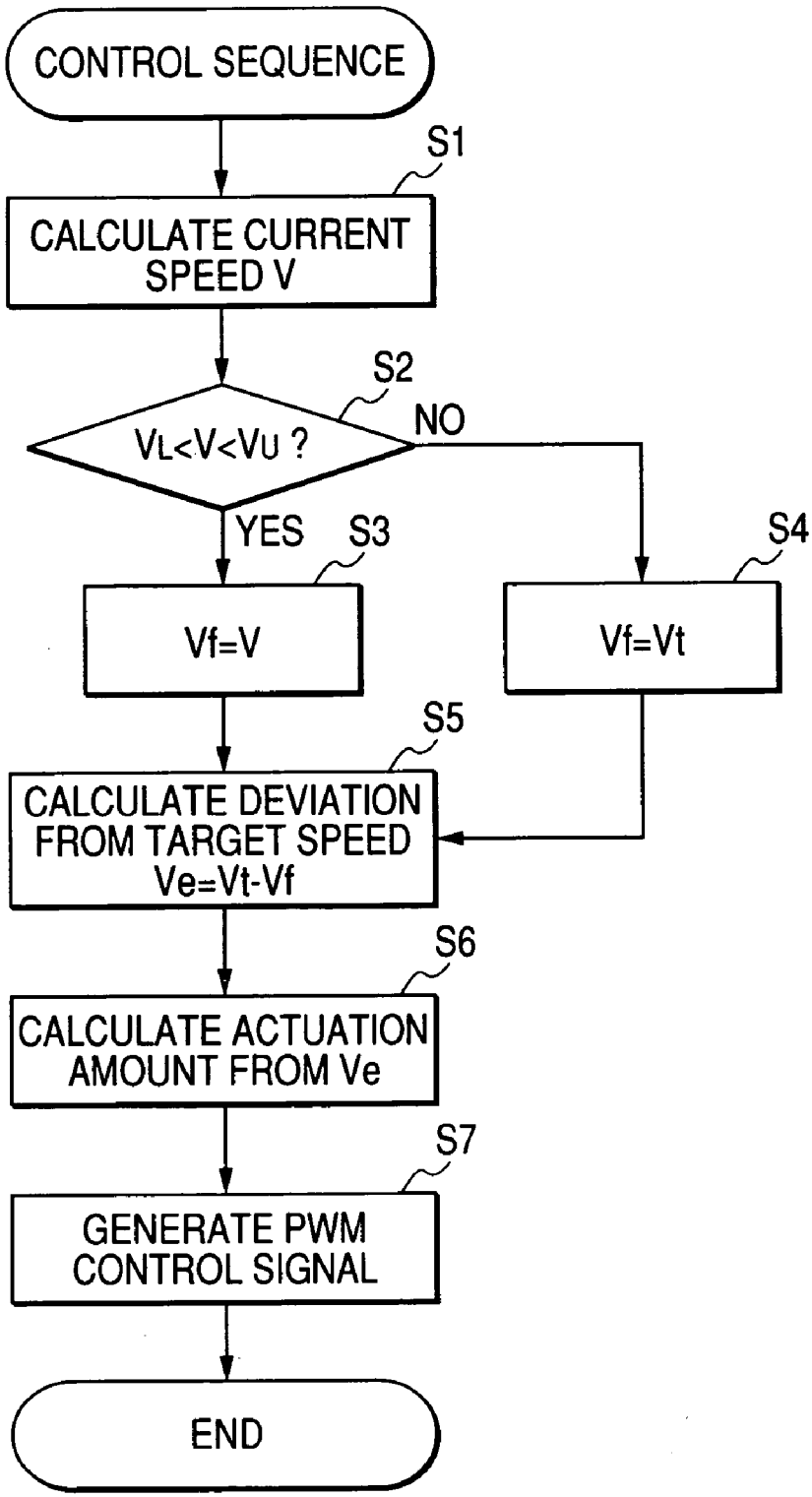
FIG. 5 is a flowchart showing the sequence of speed control of the conveyor belt shown in FIG. 3.

FIG. 5 is a flowchart showing a sequence of the speed control of the conveyor belt 49.

During circulation of the conveyor belt 49, that is, during driving of the motor 62, the sequence shown in FIG. 5 is repeatedly executed.

If the encoder edge detecting unit 73 detects an edge of an output signal of the encoder 61 (switching from a high level to a low level), the speed calculating unit 74 first obtains an elapsed time from when the edge of the output signal of the encoder 61 has been detected, to calculate the speed V of the conveyor belt 49 from the elapsed time (S1).

Next, the feedback amount selecting unit 75 determines whether or not the speed V is included within a normal range defined by the upper normal range limit $V_U$ and the lower normal range limit $V_L$ (S2). In other words, the feedback amount selecting unit 75 determines whether or not the speed V calculated by the speed calculating unit 74 is greater than the lower normal range limit $V_L$ stored in the register group 72 and is smaller than the upper normal range limit $V_U$ stored in the register group 72.

The upper normal range limit $V_U$ and the lower normal range limit $V_L$ are determined by, for example, normal range determination processing as will be described below, and the normal range defined by the upper normal range limit $V_U$ and the lower normal range limit $V_L$ corresponds to the width of the change in the speed V normally calculated by the speed calculating unit 74 when the pattern member 67 is irradiated with the light from the light-emitting element 68 during circulation of the conveyor belt 49. Accordingly, if the speed V calculated by the speed calculating unit 74 is within the normal range, it can be determined that the speed V is almost equal to an actual speed of the conveyor belt 49, while if the speed V calculated by the speed calculating unit 74 is out of the normal range, it can be determined that the speed V is not a value obtained by precisely calculating an actual speed of the conveyor belt 49. For example, because an edge of an output signal of the encoder 61 is not detected over a predetermined time while a joint of the pattern member 67 is irradiated with the light from the light-emitting element 68 or while the toner adhered over a plurality of marks 66 is irradiated with the light from the light-emitting element 68, the speed V is erroneously calculated by the speed calculating unit 74.

Thus, if the speed V calculated by the speed calculating unit 74 is included within the predetermined normal range (YES in S2), the speed V is set to the feedback amount Vf (S3). Then, the speed feedback control operating unit 76 calculates a deviation Ve between the feedback amount Vf=V and the target speed Vt (S5) to operate an actuation amount U corresponding to the deviation Ve (S6).

On the other hand, if the speed V calculated by the speed calculating unit 74 is out of the normal range (NO in S2), the target speed Vt, not the speed V is set to the feedback amount Vf (S3). Then, the speed feedback control operating unit 76 calculates a deviation Ve between the feedback amount Vf=Vt and the target speed Vt (S5) to operate the actuation amount U corresponding to the deviation Ve=0 (S6).

If the actuation amount U is operated in this way, the PWM generating unit 77 generates a PWM control signal corresponding to the actuation amount U (S7). Then, this PWM control signal is given to the motor driver 63, whereby a driving power corresponding to the actuation amount U is supplied to the motor 62 from the motor driver 63.

If the speed V calculated by the speed calculating unit 74 is out of the normal range as described above, the target speed Vt is used as the feedback amount Vf, the actuation amount U corresponding to the deviation Ve=0 between this feedback amount Vf=Vt and the target speed Vt is operated, and a driving power corresponding to this actuation amount U is supplied to the motor 62. Thus, the speed of the conveyor belt 49 can be prevented from greatly deviating from the target speed Vt. Therefore, even when the pattern member 67 has any joint or toner is adhered over a plurality of marks 66, the conveyor belt 49 can be stably driven with no irregularity in the speed of the conveyor belt 49. As a result, occurrence of deviation in a transfer position of a toner image of each color on the sheet 3 can be prevented, and thus a high-quality color image can be formed on the sheet 3.

Figure 6:
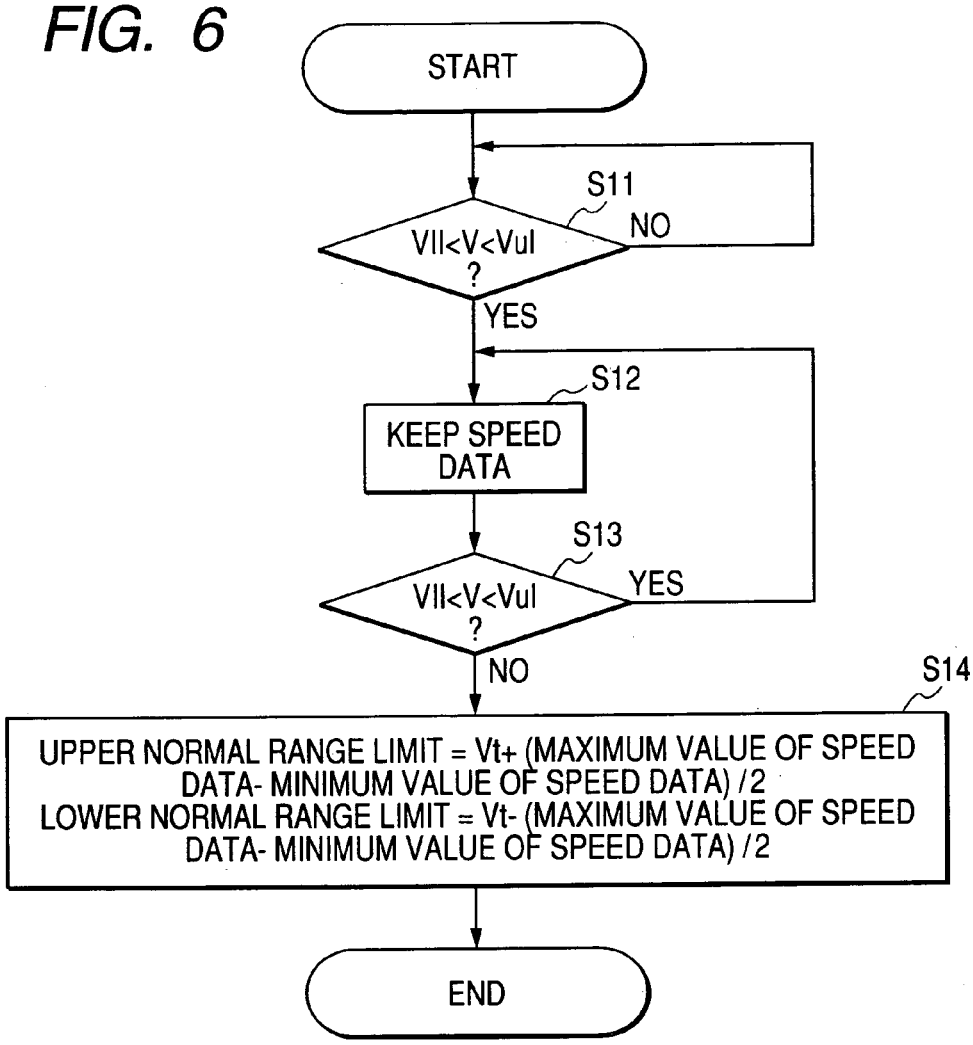
FIG. 6 is a flowchart for explaining normal range determination processing.

FIG. 6 is a flowchart for explaining normal range determining processing.

The normal range determination processing is executed by the CPU 71, for example, when the conveyor belt 49 is driven for the first time after power is input to the color laser printer 1. In the normal range determination processing, the lower normal range limit $V_L$ and the upper normal range limit $V_U$ are respectively determined on the basis of the speed V calculated by the speed calculating unit 74.

Specifically, when the speed V is first calculated by the speed calculating unit 74, it is determined whether or not the speed V is included within a range defined by a predetermined provisional lower limit Vll and a predetermined provisional upper limit Vul (S11). That is, it is determined whether or not the speed V calculated by the speed calculating unit 74 is greater than the provisional lower limit Vll and smaller than the provisional upper limit Vul.

If the speed V is not included within the range defined by the provisional lower limit Vll and the provisional upper limit Vul (NO in S11), in other words, if a joint of the pattern member 67, etc. is irradiated with the light from the light-emitting element 68 of the reflective sensor 70, and an abnormal value resulting from this is calculated, the processing does not proceed to the next step. When the speed V is newly calculated by the speed calculating unit 74, whether or not the calculated speed V is within the range defined by the provisional lower limit Vll and the upper limit value Vul is again determined.

If the speed V included within the range defined by the provisional low limit Vll and the provisional upper limit Vul is calculated (YES in S11), data on the speed V is temporarily kept in a buffer memory (not shown) (S12). Thereafter, speeds V calculated by the speed calculating unit 74 are sequentially kept in the buffer memory until a speed V out of the predetermined range defined by the provisional lower limit Vll and the provisional upper limit Vul is calculated, that is, until a joint of the pattern member 67, etc. is again irradiated with the light from the light-emitting element 68 of the reflective sensor 70 and an abnormal value resulting from this is again calculated.

Then, if the speed V out of the range defined by the provisional lower limit Vll and the provisional upper limit Vul is calculated (NO in S13), a maximum value and a minimum value of the speed V kept in the buffer memory till that moment are obtained. Then, the minimum value is subtracted from the maximum value, and a value obtained by dividing a value obtained from the subtraction by two is added to a target speed Vt to obtain an additional value, and the additional value is determined to be the upper normal range limit $V_U$, while a value obtained by subtracting the value, which is obtained by dividing the value obtained from the subtraction by two, from the target speed Vt, is determined to be the lower normal range limit $V_L$ (S14).

Since the lower normal range limit $V_L$ and the upper normal range limit $V_U$ are respectively determined on the basis of the speed V calculated by the speed calculating unit 74, a normal range defined by these upper and lower limits can be used as a range corresponding to characteristics of the color laser printer 1. Therefore, regardless of differences between individual color laser printers 1, whether or not the speed V calculated by the speed calculating unit 74 is used as the feedback amount Vf or whether the target speed Vt is used as the feedback amount Vf can be properly selected. Therefore, high-precision feedback control can be achieved and thus the conveyor belt 49 can be driven more stably.

Figure 7:
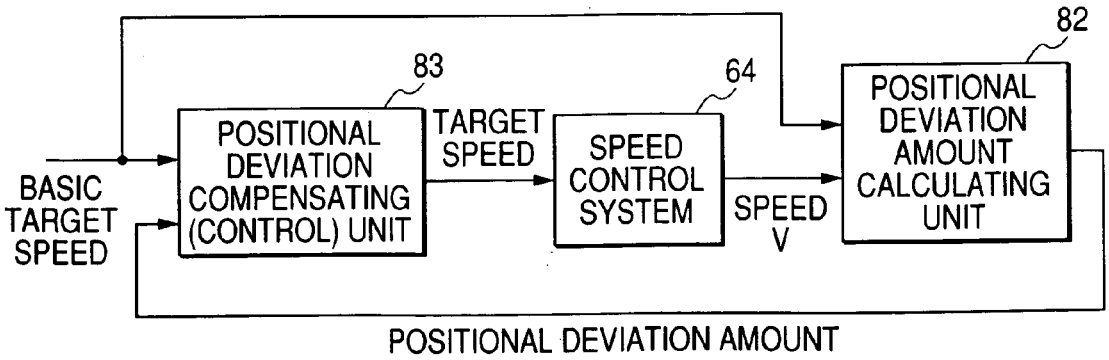
FIG. 7 is a block diagram showing a configuration for setting a target speed.

FIG. 7 is a block diagram showing a configuration for setting the target speed Vt.

The color laser printer 1 includes a positional deviation amount calculating unit 82 as a positional deviation amount calculating unit which calculates, as a positional deviation amount, a cumulative value of deviations between a predetermined basic target speed and speeds (speeds V calculated by the speed calculating unit 74 provided in the ASIC 64) of the conveyor belt 49 in order to set a target speed Vt to be used for the speed control of the conveyor belt 49 by the ASIC 64 (speed control system), and a positional deviation amount compensating (control) unit 83 as a positional deviation compensating unit which sets, as the target speed Vt, a deviation between the basic target speed and a value obtained by multiplying the positional deviation amount calculated by the positional deviation amount calculating unit 82 by a predetermined proportional control gain Kp.

Figure 8:
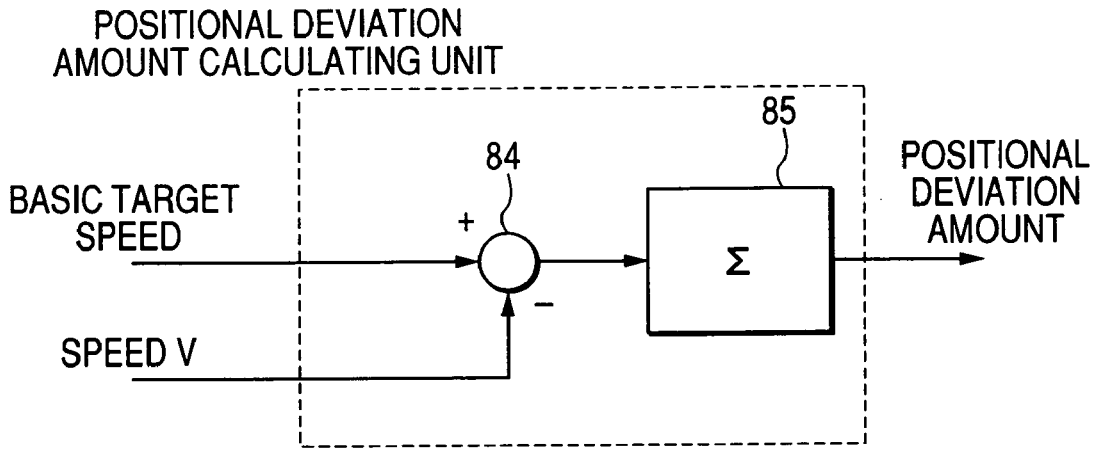
FIG. 8 is a block diagram showing the configuration of a positional deviation amount calculating unit shown in FIG. 7.

More specifically, as shown in FIG. 8, the positional deviation amount calculating unit 82 includes a deviation operating unit 84 which operates a deviation between a basic target speed and a speed V calculated by the speed calculating unit 74, and a cumulative operating unit 85 which operates a cumulative value (sum) of deviations to be operated by the cumulative operating unit 85. The cumulative value to be operated by the cumulative operating unit 85 is used as the positional deviation amount.

Figure 9:
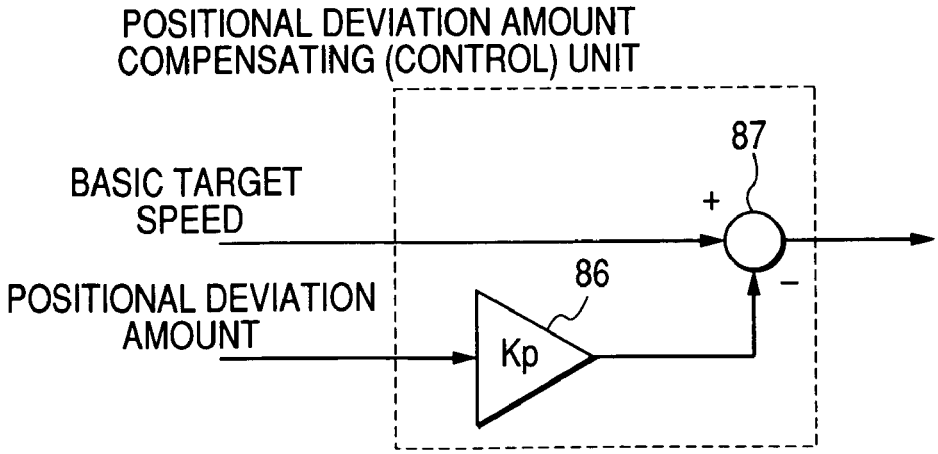
FIG. 9 is a block diagram showing the configuration of a positional deviation compensating unit shown in FIG. 7.

As shown in FIG. 9, the positional deviation amount compensating unit 83 includes a multiplying unit 86 which multiply the positional deviation amount calculated by the positional deviation amount calculating unit 82 by a predetermined proportional control gain Kp, and a deviation operating unit 87 which operates a deviation between a multiplied value obtained by the multiplying unit 86 and the basic target speed. The deviation to be operated by the deviation operating unit 87 is used as the target speed Vt.

If deviations between the basic target speed and the speed of the conveyor belt 49 are cumulated, the deviation amount of an actual rotational position with respect to a normal rotational position of the conveyor belt 49 increases accordingly. However, by setting the target speed Vt on the basis of a cumulative value of deviations, any cumulation of the deviations can be prevented, and thus positional deviation of the rotational position of the conveyor belt 49 can be compensated. Therefore, the more stable conveyance of the sheet 3 by the conveyor belt 49 can be achieved.

Figure 10:
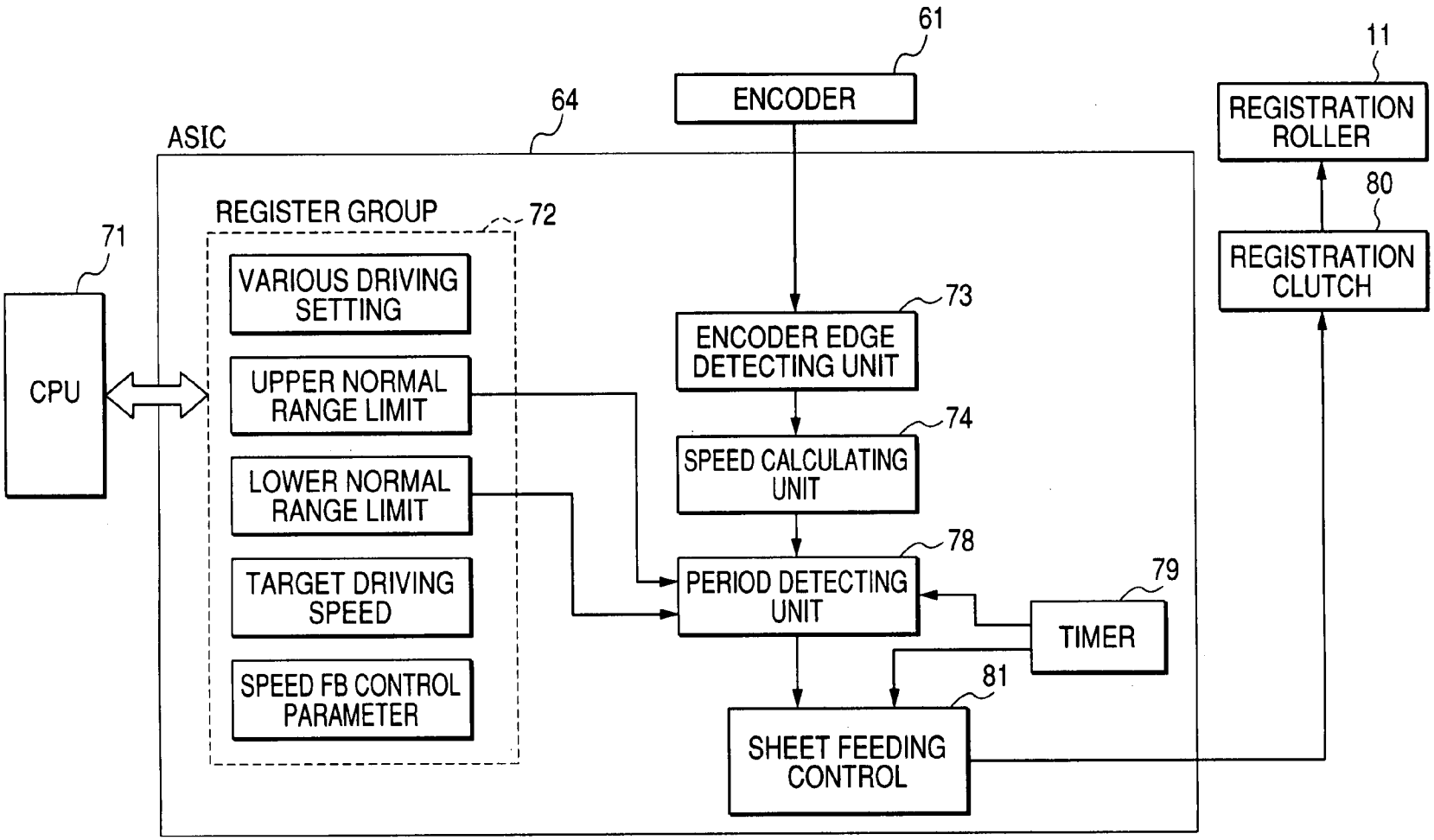
FIG. 10 is a block diagram showing a control system for controlling feeding of a sheet onto the conveyor belt shown in FIG. 1.

FIG. 10 is a block diagram showing a control system for controlling supply of a sheet onto the conveyor belt 49. In FIG. 10, the same reference numerals as those in FIG. 3 are given to the parts corresponding to the respective parts shown in FIG. 3.

The control system shown in FIG. 10 is incorporated into the ASIC 64, and includes a period detecting unit 78 as a period detecting unit which detects, when speeds V out of a normal range are periodically calculated by the speed calculating unit 74, the period T, a timer 79 as an elapsed time measuring unit which measures an elapsed time t from a point of time from when a speed V out of a normal range is calculated, a sheet feed control unit 81 as a supply control unit which controls a registration clutch 80 for switching transmission or interruption of a driving force to the registration rollers 11.

The period detecting unit 78 detects, for example, the time measured by the timer 79 from when a speed V out of the normal range is first calculated by the speed calculating unit 74 to when another speed V out of the normal range is next calculated by the speed calculating unit 74, as a period T during which a speed V out of the normal range is calculated by the speed calculating unit 74.

Figure 11:
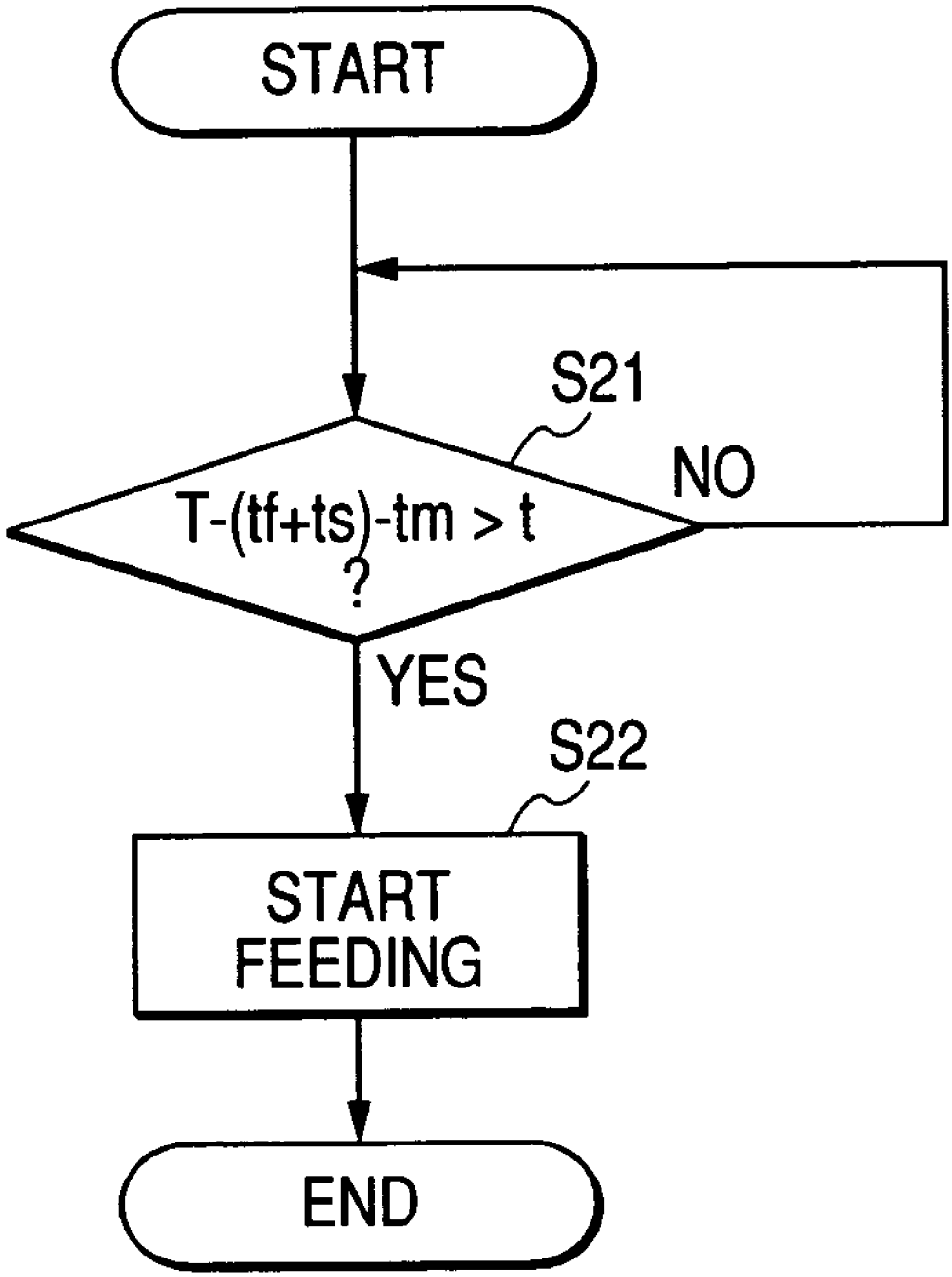
FIG. 11 is a flowchart showing the control sequence to be executed by a sheet feed control unit shown in FIG. 10.

Assuming that the time taken until a leading end of a sheet 3 has arrived at the conveyor belt 49 from the start of rotation of the registration rollers 11 is tf, and the time taken for the conveyor belt 49 to convey one sheet 3 (the time taken until a trailing end of the sheet 3 is separated from the conveyor belt 49 after the leading end of the sheet 3 has arrived at the conveyor belt 49) is ts, the sheet feed control unit 81, as shown in FIG. 11, subtracts the time tf and the time ts from the period T detected by the period detecting unit 78, and further subtracts a predetermined extra time tm from the period, and then determines whether or not the resulting remaining time is longer than the elapsed time t measured by the timer 79 (S21).

Then, if the remaining time is longer than the elapsed time t, the registration clutch 80 is immediately turned on to start the feeding of the sheet 3 by the registration rollers 11 (S22).

On the other hand, if the remaining time is shorter than the elapsed time t, then the sheet feed control unit waits until a speed V out of the predetermined normal range is calculated by the speed calculating unit 74. Thereafter, If the speed V out of the predetermined normal range is calculated, the sheet feed control unit turns on the registration clutch 80 to start feeding of the sheet 3 by the registration rollers 11 (S22).

While the speed V calculated by the speed calculating unit 74 is out of the predetermined normal range, there is a fear that a control is performed which may make the speed of the conveyor belt 49 unstable. Thus, as in the present example structure, if the remaining time obtained by subtracting the time tf and the time ts from the period T, and further subtracting the predetermined extra time tm from the period, is shorter than the elapsed time t after the speed V out of the predetermined normal range is calculated by the speed calculating unit 74, the sheet feed control unit waits until another speed out of the predetermined normal range is calculated by the speed calculating unit 74 and thereafter starts feeding of the sheet 3 by the registration rollers 11. As a result, the conveyance of the sheet 3 by the conveyor belt 49 can be completed until another speed V out of the normal range is calculated next by the speed calculating unit 74. Therefore, better stability and high-precision conveyance of the sheet 3 can be achieved.

Figure 12:
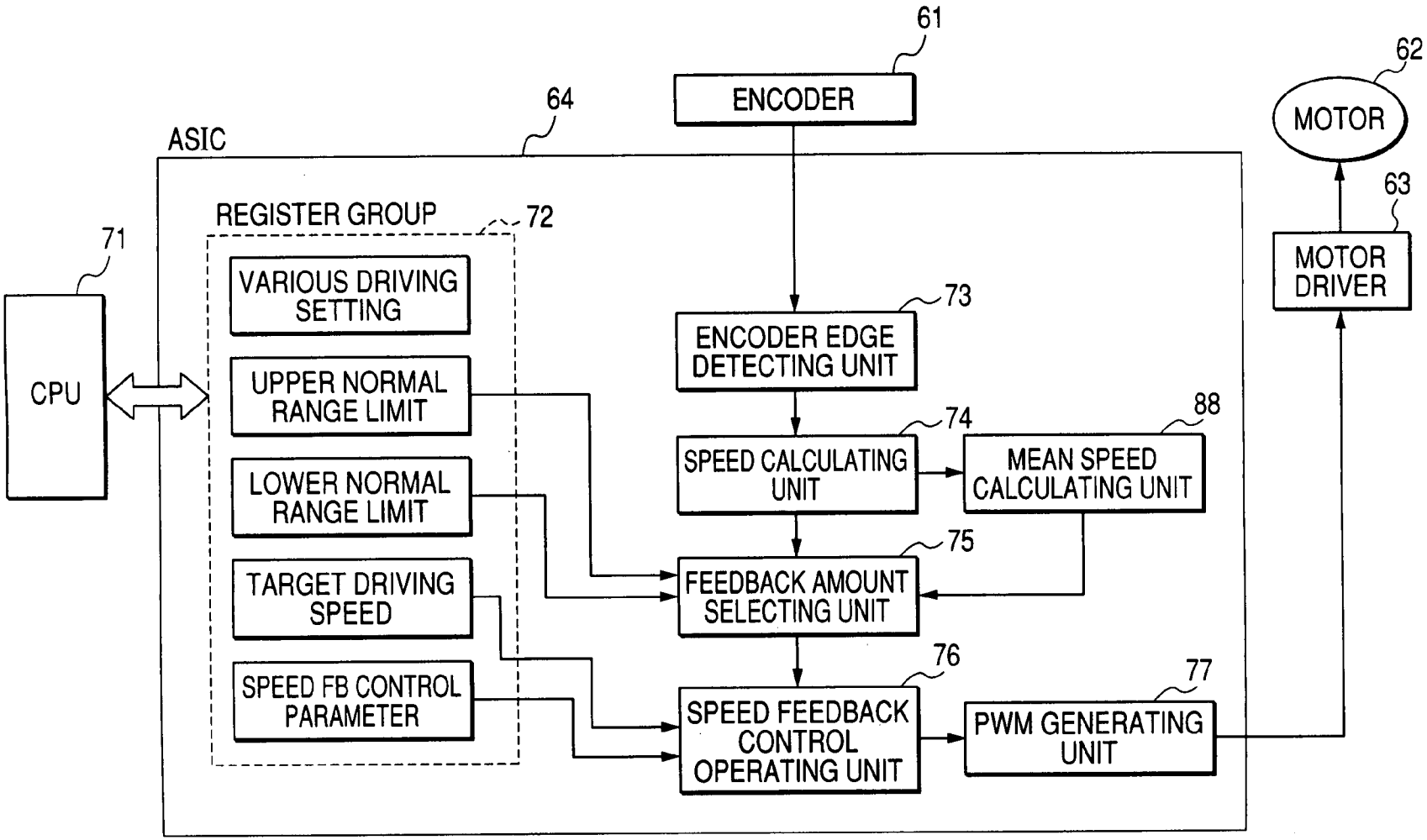
FIG. 12 is a block diagram showing another illustrative example of the invention (in which a mean speed is used) of the control system for speed control of the conveyor belt.

FIG. 12 is a block diagram showing another example structure of the control system for speed control of the conveyor belt. In FIG. 10, the same reference numerals as those in FIG. 3 are given to the parts corresponding to the respective parts shown in FIG. 3.

The control system shown in FIG. 12 includes a mean speed calculating unit 88 as a storage unit and a mean value calculating unit. The mean speed calculating unit 88 stores speeds V calculated by the speed calculating unit 74 from when a speed V out of the normal range is first calculated by the speed calculating unit 74 to when another speed V out of the normal range is next calculated by the speed calculating unit 74, and calculates a mean speed Vm of a plurality of the stored speeds V. In other words, the mean speed calculating unit 88 uses, as a target, the period from when a speed V out of the normal range is first calculated by the speed calculating unit 74 to when another speed V out of the normal range is next calculated by the speed calculating unit 74, to store only speeds V included within the normal range during the period, and calculates a mean speed of the speeds V included within the normal range, whereby the mean speed Vm from which influence of the speeds V out of the predetermined normal range is excluded is calculated.

The feedback amount selecting unit 75 reads out a upper normal range limit $V_U$ and a lower normal range limit $V_L$ which are stored in the register group 72, compares a current speed V of the conveyor belt 49 calculated by the speed calculating unit 74 with the upper normal range limit $V_U$ and the lower normal range limit $V_L$, respectively, so as to determine whether or not the current speed is greater than the upper normal range or the lower normal range limit, and selects any one of the current speed V of the conveyor belt 49 and the mean speed Vm calculated by the mean speed calculating unit 88, as a feedback amount Vf.

Figure 13:
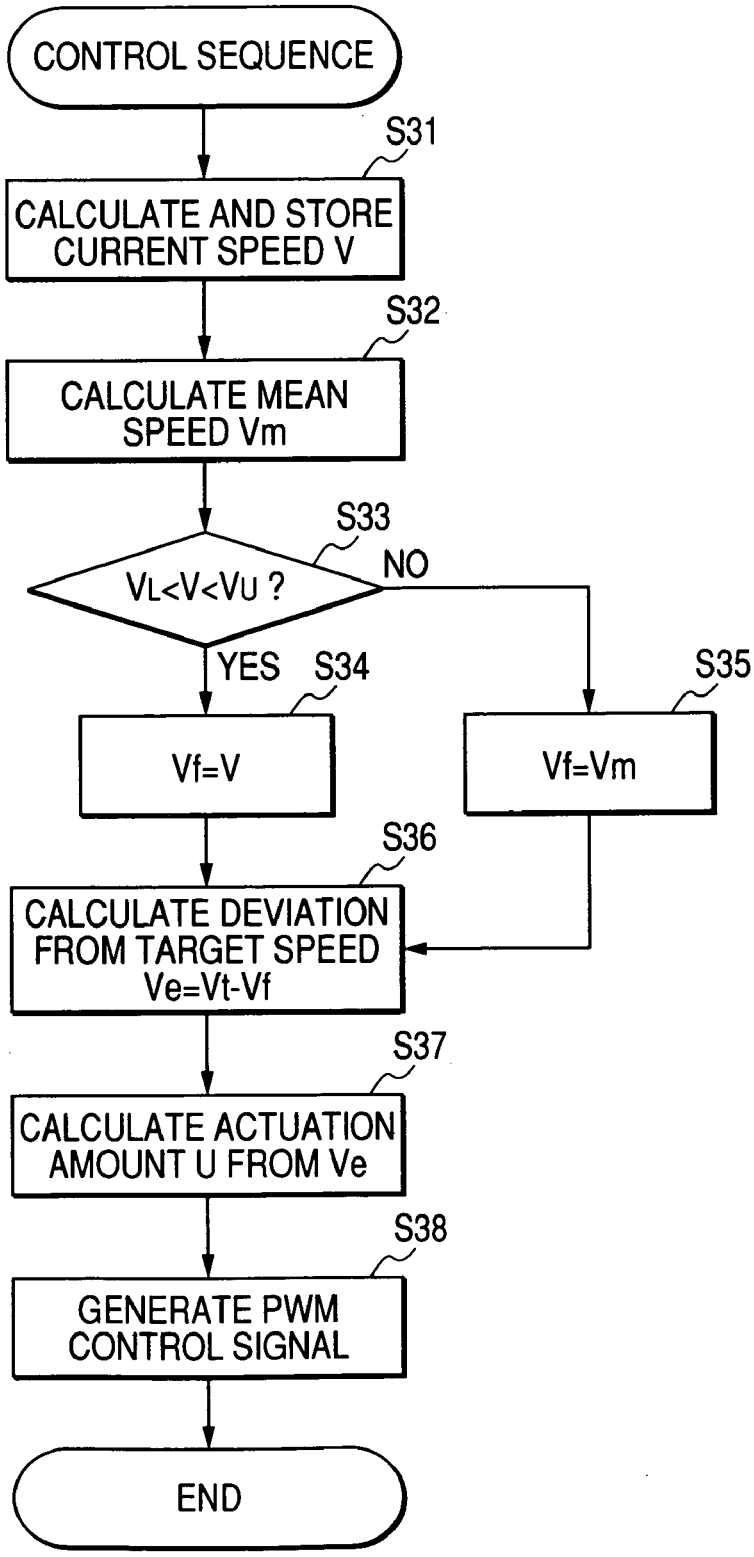
FIG. 13 is a flowchart showing the sequence of speed control of the conveyor belt by the control system shown in FIG. 12.

FIG. 13 is a flowchart showing the sequence of speed control of the conveyor belt 49 by the control system shown in FIG. 12.

During circulation of the conveyor belt 49, that is, during driving of the motor 62, the sequence shown in FIG. 12 is repeatedly executed.

If the encoder edge detecting unit 73 detects an edge (switching from a high level to a low level) of an output signal of the encoder 61, the speed calculating unit 74 calculates the speed V of the conveyor belt 49 (S31). The calculated speed V is stored in the mean speed calculating unit 88 (S31).

Next, the mean speed calculating unit 88 calculates the mean speed Vm (S32).

Thereafter, the feedback amount selecting unit 75 determines whether or not the speed V is included within a normal range defined by the upper normal range limit $V_U$ and the lower normal range limit $V_L$ (S33).

If the speed V calculated by the speed calculating unit 74 is included within the normal range (YES in S33), the speed V is set to the feedback amount Vf (S34) Then, the speed feedback control operating unit 76 calculates a deviation Ve between the feedback amount Vf=V and the target speed Vt (S36) to operate an actuation amount U corresponding to the deviation Ve (S37).

On the other hand, if the speed V calculated by the speed calculating unit 74 is out of the predetermined normal range (NO in S33), a mean speed Vm calculated by the mean speed calculating unit 88, not the speed V, is set to the feedback amount Vf (S35). Then, the speed feedback control operating unit 76 calculates a deviation Ve between the feedback amount Vf=Vm and the target speed Vt (S36) to operate an actuation amount U corresponding to the deviation Ve (S37).

If the actuation amount U is operated in this way, the PWM generating unit 77 generates a PWM control signal corresponding to the actuation amount U (S38). Then, this PWM control signal is given to the motor driver 63, whereby a driving power corresponding to the actuation amount U is supplied to the motor 62 from the motor driver 63.

The mean speed Vm calculated by the mean speed calculating unit 88 becomes a value from which an instantaneous change in the speed V calculated by the speed calculating unit 74 is excluded, and that is almost equal to the target speed Vt. Thus, if the speed V calculated by the speed calculating unit 74 is out of the normal range, the mean speed Vm is used as the feedback amount Vf, the actuation amount U corresponding to the deviation Ve between this feedback amount Vf=Vm and the target speed Vt is calculated, and a driving power corresponding to this actuation amount U is supplied to the motor 62. Thus, the speed of conveyor belt 49 can be prevented from greatly deviating from the target speed Vt. Therefore, even when the pattern member 67 has any joint or toner is adhered over a plurality of marks 66, the conveyor belt 49 can also be driven stably with no irregularity in the speed by the control system of this example structure. As a result, occurrence of deviation in a transfer position of a toner image of each color on the sheet 3 can be prevented, and thus, a high-quality color image can be formed on the sheet 3.

Further, since a plurality of speeds V measured in the past by the speed calculating unit 74 are stored in the mean speed calculating unit 88, the mean speed Vm can be surely and easily calculated by the mean speed calculating unit 88.

Further, since the period from when a speed V out of the normal range is first calculated by the speed calculating unit 74 to when another speed V out of the normal range is next calculated, is used as the period for which the mean speed Vm is to be calculated, the mean speed Vm of a plurality of speeds V within the normal range can be certainly obtained. Therefore, the mean speed Vm of a plurality of speeds V can be certainly a value within the normal range, and thus, the conveyor belt 49 can be more stably driven by feedback control on the basis of the mean speed Vm.

Figure 14:
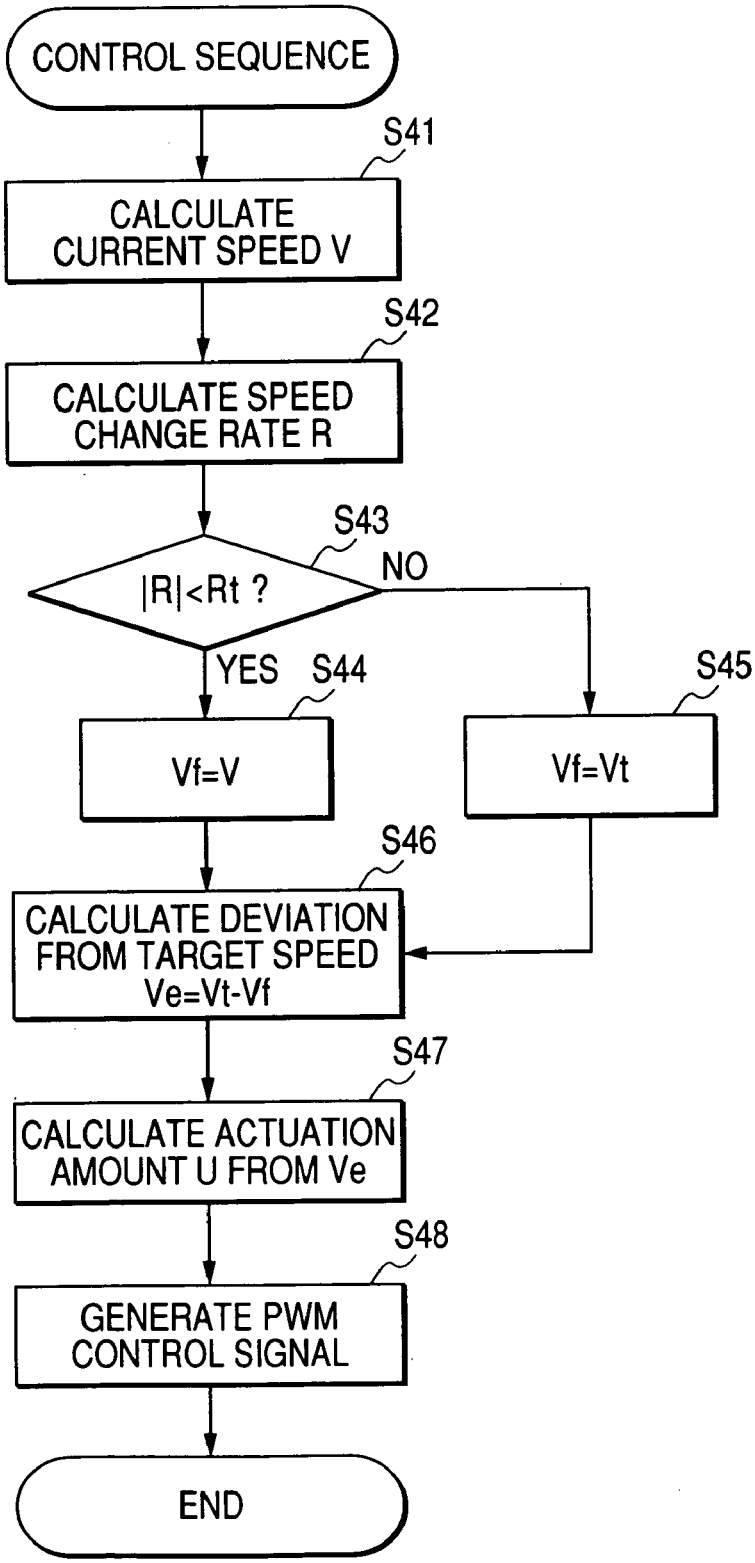
FIG. 14 is a flowchart showing still another illustrative example of the invention (in which a feedback amount is determined based on a speed change rate) of the speed control of the conveyor belt by the control system shown in FIG. 3.
Figure 15:
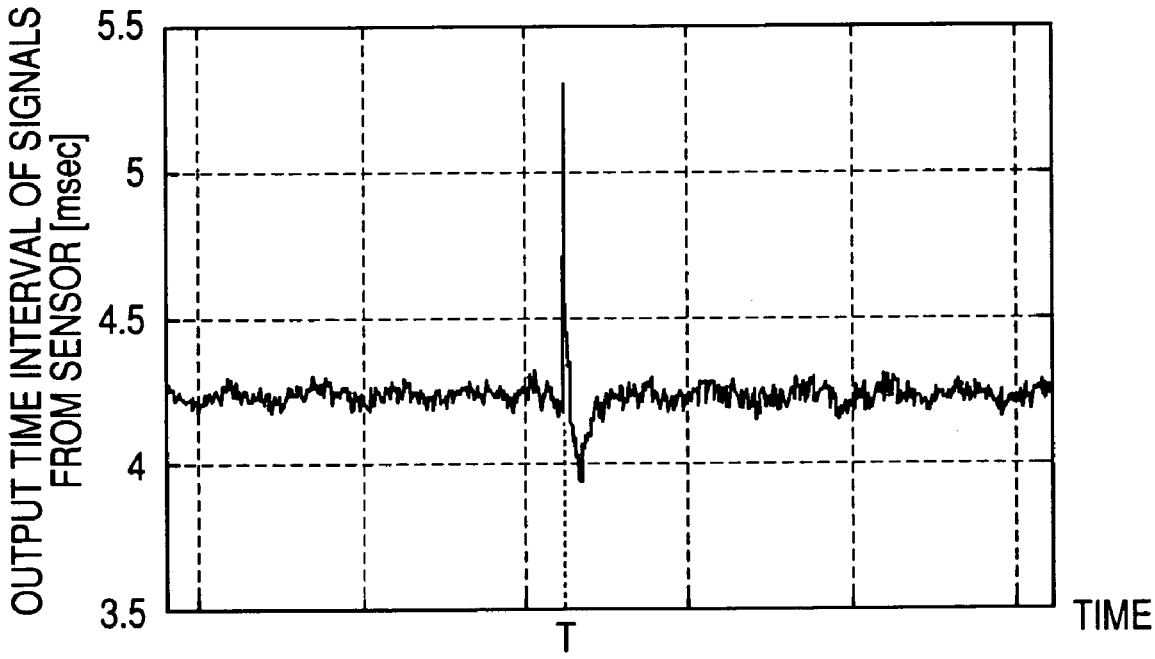
FIG. 15 is a graph showing changes in the interval of output signals of a sensor.

FIG. 14 is a flowchart showing another example structure of the speed control of the conveyor belt 49 by the control system shown in FIG. 3.

During circulation of the conveyor belt 49, that is, during driving of the motor 62, the sequence shown in FIG. 14 is repeatedly executed.

If the encoder edge detecting unit 73 detects an edge (switching from a low level to a high level) of an output signal of the encoder 61, the speed calculating unit 74 calculates a speed V of the conveyor belt 49 (S41).

Next, the feedback amount selecting unit 75 calculates a speed change rate R of the speed V previously calculated by the speed calculating unit 74 (a differential value of the speed V (S42), and then determines whether or not an absolute value of the speed change rate R is smaller than a predetermined threshold value Rt (S43).

The threshold value Rt is set to a maximum value of an absolute value of a speed change rate of a speed V normally calculated by the speed calculating unit 74 when the pattern member 67 is irradiated with the light from the light-emitting element 68 during circulation of the conveyor belt 49. Accordingly, if the absolute value of the speed change rate R is smaller than the threshold value Rt, it can be determined that the speed V calculated by the speed calculating unit 74 at that time is almost equal to an actual speed of the conveyor belt 49. On the other hand, if the absolute value of the speed change rate R is greater than the threshold value Rt, it can be determined that the speed V calculated by the speed calculating unit 74 at that time is not a value obtained by properly calculating an actual speed of the conveyor belt 49. For example, because an edge of an output signal of the encoder 61 is not detected over a predetermined time while a joint of the pattern member 67 is irradiated with the light from the light-emitting element 68 or while the toner adhered over the plurality of marks 66 is irradiated with the light from the light-emitting element 68, the speed V is erroneously calculated by the speed calculating unit 74. As a result, the speed change rate R becomes more than the threshold value Rt.

Thus, if the speed change rate R is smaller than the threshold value Rt (YES in S43), the speed V calculated by the speed calculating unit 74 at that time is set to the feedback amount Vf (S44). Then, the speed feedback control operating unit 76 calculates a deviation Ve between the feedback amount Vf=V and the target speed Vt (S46) to operate the actuation amount U corresponding to the deviation Ve (S47).

On the other hand, if the speed change rate R is greater than the threshold value Rt (NO in S43), the target speed Vt, not the speed V calculated by the speed calculating unit 74 at that time, is set to the feedback amount Vf (S45). Then, the speed feedback control operating unit 76 calculates a deviation Ve between the feedback amount Vf=Vt and the target speed Vt (S46) to operate the actuation amount U corresponding to the deviation Ve=0 (S47).

If the actuation amount U is operated in this way, the PWM generating unit 77 generates a PWM control signal corresponding to the actuation amount U (S48). Then, this PWM control signal is given to the motor driver 63, whereby a driving power corresponding to the actuation amount U is supplied to the motor 62 from the motor driver 63.

By the sequence in FIG. 14, the effects similar to those by the sequence in FIG. 3 can also be exhibited.

In addition, the configuration in which the speed of the conveyor belt 49 is calculated by the speed calculating unit 74 and feedback control is performed based thereon is exemplified in the above description. However, the following configuration may be adopted, for example. That is, an interval (output interval) from when an edge of an output signal of the encoder 61 is first detected to when an edge of another output signal of the encoder 61 is next detected is measured. Then, if the output interval is within a predetermined normal range, the measured output interval is selected as a feedback amount, while if the output interval is out of the normal range, a target interval that is a target value of an output interval of a signal from the encoder 61, or a mean value of output intervals is selected as the feedback amount, the actuation amount U is calculated on the basis of a deviation between the target interval and the feedback amount. Since the output interval of signals from the encoder 61 corresponds to the speed of the conveyor belt 49, this configuration is substantially the same as the configuration of the above-described example structures and thus the effects as described above can be exhibited.

Further, the tandem laser printer 1 of the direct transfer type in which transfer is performed on the sheet 3 directly from each photosensitive drum 16 is exemplified. However, the invention is not limited to this type of printer. For example, the invention may be applied to a color laser printer of an intermediate transfer type in which a toner image of each color is transferred once from each photosensitive member to an intermediate transfer belt, and then transferred to a sheet at one time. In this case, the rotating body of the invention may be an intermediate transfer belt. Further, the image forming apparatus of the invention may be a monochrome laser printer.

Moreover, a plurality of pattern members 67 may be arranged in parallel on the surface of the conveyor belt 49 along one end of the conveyor belt 49 in its width direction. In this case, the respective pattern members 67 do not overlap each other, but a minute gap may be formed between the pattern members 67.

Further, in the normal range determination processing shown in FIG. 6, the following technique may be adopted instead of the determination technique of the predetermined normal range shown in Step S14. That is, in the period from when a speed V out of a range defined by the provisional lower limit Vll and the provisional upper limit Vul is first calculated to when another speed V out of such a range is next calculated, a range defined by a maximum value and a minimum value of data of a speed V (data on a speed V included within the range defined by the provision lower limit Vll and the provisional upper limit Vul) temporarily kept in a buffer memory is used as an error range, and an appropriate range including this error range may be used as the normal range. By using a range broader than the error range as the normal range as described above, whether the speed V calculated by the speed calculating unit 74 is used as the feedback amount Vf or whether the target speed Vt or the mean speed Vm is used as the feedback amount Vf can be more precisely selected. Therefore, high-precision feedback control can be achieved, and thus the conveyor belt 49 can be even more stably circulated.

Further, a range obtained by multiplying the thus obtained error range by a given factor may be used as the normal range. In this case, the normal range can be surely set to a range broader than the error range.

It is considered that the error range varies depending on the environment (temperature, humidity, atmosphere, etc.) of the color laser printer 1 or deterioration degree. Thus, preferably, experiments are made under the various conditions to obtain error ranges under the individual conditions, and on the basis of the greatest error range (maximum error range) of the obtained error ranges, a factor to be multiplied by the error range is determined.

According to the above, if a current actual interval measured by the actual interval measuring unit is out of a predetermined normal range, the rotation of the rotating body is controlled in a feedback manner by using a mean value of a plurality of actual intervals measured in the past by the actual interval measuring unit instead of the current actual interval, as a feedback amount. For example, if the position of a mark deviates from a normal position or a developing agent is adhered over a plurality of marks, an actual interval measured by the actual interval measuring unit is out of the predetermined normal range. This actual interval out of the normal range does not precisely correspond to an actual rotational speed of the rotating body. If the rotation of the rotating body is controlled in a feedback manner based on the actual interval, the rotation of the rotating body may become unstable. In order to avoid this defect, it is considered that, if an actual interval measured by the actual interval measuring unit is out of the normal range, the rotation of the rotating body is controlled in a feedback manner, using an immediate value of an actual interval which has just been previously measured, without using the actual interval out of the normal range. However, there is a fear that the immediate value of the actual interval which has just been previously measured does not necessarily correspond precisely to the rotational speed of the rotating body, but it may be out of the normal range.

In contrast, a mean value of a plurality of actual intervals measured in the past by the actual interval measuring unit becomes a value from which a change in an immediate value of an actual interval is excluded and that is almost equal to a target value. Thus, if actual intervals are out of a predetermined normal range, a mean value thereof is used as a feedback amount in feedback control of the rotation of the rotating body, so that the rotation of the rotating body can be prevented from becoming unstable. Therefore, even when the position of a mark is out of a normal position or a developing agent is adhered over a plurality of marks, the rotating body can be rotated stably.

According to the example structures, since a plurality of actual intervals measured in the past by the actual interval measuring unit are stored in the storage unit, a mean value of the actual intervals can be surely and easily calculated.

According to the example structures, since a mean value of a plurality of actual intervals within the normal range is obtained, the mean unit is included within the normal range. Therefore, by using the mean value to control the rotation of the rotating body in the feedback manner, the rotation of the rotating body can be prevented from becoming unstable, and thus the rotating body can be rotated more stably.

According to the example structures, since the period for which a mean value of a plurality of actual intervals is to be calculated is used as the period from when an actual interval out of the normal range is first calculated by the actual interval measuring unit to when another actual interval out of the normal range is next calculated, a mean value of a plurality of actual intervals within the normal range can be surely obtained. Therefore, the mean value of a plurality of actual intervals can be certainly a value within the normal range, and thus the rotating body can be more stably rotated by feedback control on the basis of the mean value.

According to the example structures, if a current actual interval measured by the actual interval measuring unit is out of a predetermined normal range, the rotation of the rotating body is controlled in a feedback manner by using a target interval that is a target value of the output interval of the pulses from the sensor instead of the current actual interval, as a feedback amount. For example, if the position of a mark is out of a normal position or a developing agent is adhered over a plurality of marks, an actual interval measured by the actual interval measuring unit is out of a predetermined normal range. This actual interval out of the predetermined normal range does not precisely correspond to an actual rotational speed of the rotating body. If the rotation of the rotating body is controlled in a feedback manner based on this actual interval, the rotation of the rotating body may become unstable. In order to avoid this defect, it is considered that, if an actual interval measured by the actual interval measuring unit is out of the predetermined normal range, the rotation of the rotating body is controlled in a feedback manner, using an immediate value of an actual interval which has just been previously measured, without using the actual interval out of the predetermined normal range. However, there is a fear that the immediate value of the actual interval which has just been previously measured does not necessarily correspond precisely to the rotational speed of the rotating body, but it may be out of the normal range.

In contrast, if actual intervals are out of a normal range, a target value is used as a feedback amount in feedback control of the rotation of the rotating body, so that the rotation of the rotating body can be prevented from becoming unstable. Therefore, even when the position of a mark is out of a normal position or a developing agent is adhered over a plurality of marks, the rotating body can be stably rotated.

According to the example structures, regardless of the differences between individual image forming apparatuses, whether the actual interval calculated by the actual interval measuring unit is used as the feedback amount or the target interval is used as the feedback amount can be properly selected. Therefore, high-precision feedback control can be achieved and thus the rotating body can be driven more stably.

According to the example structures, since an actual interval measured by the actual interval measuring unit sometimes includes an error, whether a current actual interval measured by the actual interval measuring unit is used as the feedback amount or a mean interval of a plurality of actual intervals measured in the past or a target interval is used as the feedback amount can be properly selected. Therefore, high-precision feedback control can be achieved, and thus, the rotating body can be stably driven even better.

According to the example structures, the normal range can be surely set to a range broader than the error range.

According to the example structures, since there is a fear that the rotation of the rotating body, and further the conveyance of a recording medium by the rotating body become unstable during a period for which actual intervals are out of the predetermined normal range, a recording medium is conveyed while avoiding such a period, so that stable and high-precision conveyance of the recording medium can be achieved.

According to the example structures, if the remaining time obtained by subtracting the time for conveyance of the recording medium by the rotating body, from the period when an actual interval deviates from the normal range, is longer than the elapsed time from when the actual interval out of the normal range is measured, the conveyance of a recording medium by the rotating body can be completed until another actual interval deviates from the next predetermined normal range, even when the supply of a recording medium is started. Therefore, better stability and high-precision conveyance of the recording medium can be achieved.

According to the example structures, if the deviation between the basic target interval and the actual interval is cumulated, the deviation amount of an actual rotational position with respect to a predetermined normal rotational position (target position) of the rotating body increases accordingly. However, by setting the target value on the basis of a cumulative value of deviations, cumulation of the deviations can be prevented, and thus positional deviation of the rotational position of the rotating body can be compensated. Therefore, even better stability and high-precision conveyance of the recording medium can be achieved.

According to the example structures, better stability and high-precision conveyance of a recording medium by the conveyor belt can be achieved. Therefore, it is possible to prevent occurrence of deviation in image formation positions by a plurality of image forming unit on a recording medium. As a result, a high-quality image can be formed on a recording medium.

The foregoing description of the example structures of the present invention has been provided for the purposes of illustration and description. It is not intended to be exhaustive or to limit the invention to the precise forms disclosed. Obviously, many modifications and variations will be apparent to practitioners skilled in the art. The example structures were chosen and described in order to best explain the principles of the invention and its practical applications, thereby enabling others skilled in the art to understand the invention for various example structures and with the various modifications as are suited to the particular use contemplated. It is intended that the scope of the invention be defined solely by the following claims and their equivalents.

What is claimed is:

1. An image forming apparatus comprising:

a rotating body rotating integrally with a plurality of marks provided at intervals with one another;

a sensor that outputs pulses whenever each mark is detected;

an actual interval measuring unit that measures an actual interval that is an output interval of the pulses from the sensor;

a selecting unit that, if a current actual interval measured by the actual interval measuring unit is within a predetermined normal range, selects the current actual interval as a feedback amount, and that, if a current actual interval measured by the actual interval measuring unit is above or below the predetermined normal range, selects a target interval that is a target value of the output interval of the pulses from the sensor, instead of the current actual interval, as a feedback amount; and a control unit that compares the target interval with the feedback amount selected by the selecting unit to control rotation of the rotating body in a feedback manner so that a deviation between the target interval and the feedback amount becomes zero.

* * * * *